US007731332B2

(12) United States Patent
Hori

(10) Patent No.: US 7,731,332 B2
(45) Date of Patent: Jun. 8, 2010

(54) EJECTION HEAD, IMAGE FORMING APPARATUS AND IMAGE FORMING METHOD

(75) Inventor: Hisamitsu Hori, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 235 days.

(21) Appl. No.: 11/167,193

(22) Filed: Jun. 28, 2005

(65) Prior Publication Data

US 2005/0285896 A1 Dec. 29, 2005

(30) Foreign Application Priority Data

Jun. 29, 2004 (JP) ..... 2004-191944

(51) Int. Cl.
*B41J 2/205* (2006.01)

(52) U.S. Cl. ..... 347/43; 347/68

(58) Field of Classification Search ..... 347/12, 347/13, 40, 42, 43, 68
See application file for complete search history.

(56) References Cited

U.S. PATENT DOCUMENTS

| | | | | |
|---|---|---|---|---|
| 5,980,020 | A | 11/1999 | Miura et al. | |
| 6,328,418 | B1 * | 12/2001 | Yamada et al. | 347/40 |
| 6,488,355 | B2 | 12/2002 | Nakamura et al. | |
| 6,533,379 | B1 | 3/2003 | Kubota et al. | |
| 6,637,860 | B1 * | 10/2003 | Madeley | 347/42 |
| 6,793,319 | B2 * | 9/2004 | Ikemoto et al. | 347/40 |
| 6,808,254 | B2 | 10/2004 | Sakaida et al. | |
| 7,222,937 | B2 * | 5/2007 | Brookfield et al. | 347/40 |
| 2002/0018095 | A1 | 2/2002 | Nakamura et al. | |
| 2002/0080215 | A1 | 6/2002 | Sakaida et al. | |
| 2003/0103118 | A1 | 6/2003 | Watanabe et al. | |
| 2003/0122902 | A1 | 7/2003 | Sakaida et al. | |
| 2003/0156164 | A1 | 8/2003 | Sakaida et al. | |
| 2004/0041885 | A1 | 3/2004 | Hirota | |
| 2004/0090498 | A1 | 5/2004 | Sakaida et al. | |

FOREIGN PATENT DOCUMENTS

| | | | |
|---|---|---|---|
| JP | 7-17034 | A | 1/1995 |
| JP | 8-25635 | A | 1/1996 |
| JP | 11-240158 | A | 9/1999 |
| JP | 2001-334661 | A | 12/2001 |
| JP | 2002-166543 | A | 6/2002 |
| JP | 2002-337320 | A | 11/2002 |

* cited by examiner

*Primary Examiner*—Lamson D Nguyen
(74) *Attorney, Agent, or Firm*—Birch, Stewart, Kolasch & Birch, LLP.

(57) ABSTRACT

The ejection head comprises: n (where n is an integer not less than 2) pieces of ejection aperture groups arranged in a sub-scanning direction, each of the groups including ejection aperture rows arranged at prescribed intervals in a main scanning direction, each of the ejection aperture rows including a plurality of ejection apertures aligned in an oblique direction with a prescribed angle θ (where 0°<θ<90°) with respect to the main scanning direction, wherein: the ejection aperture groups are arranged in such a manner that phases of the ejection aperture groups disposed adjacently in the sub-scanning direction are varied in the main scanning direction so that, in projected ejection aperture rows that are obtained by projecting the ejection apertures of each of the ejection aperture groups to dispose the ejection apertures in the main scanning direction, one of the ejection apertures in one of the groups arranged adjacently in the sub-scanning direction is located between the adjacent ejection apertures in the other of the ejection aperture groups.

9 Claims, 27 Drawing Sheets

EJECTION HEAD, IMAGE FORMING APPARATUS AND IMAGE FORMING METHOD

BACKGROUND OF THE INVENTION

1. Field of the Invention

The present invention relates to an ejection head, an image forming apparatus, and an image forming method, and more particularly, relates to a structure of an ejection head and ejection control technology that reduce the visibility of unevenness caused in groups of dots formed on an ejection receiving medium (print medium).

2. Description of the Related Art

In recent years, inkjet recording apparatuses have come to be used widely as data output apparatuses for outputting images, documents, or the like. By driving recording elements, such as nozzles, provided in a recording head in accordance with data, an inkjet recording apparatus is capable of forming data onto an ejection receiving medium (recording medium), such as paper with ink ejected from the nozzles.

In an inkjet recording apparatus, a desired image is formed on a print medium by causing a print head having a plurality of nozzles and a print medium to move relatively to each other while ink droplets are ejected from the nozzles.

The inkjet head used in an inkjet recording apparatus may be a full line head having at least one nozzle row of a length corresponding to the full width of the print medium, or a serial head that forms a dot row in a main scanning direction by scanning with a short head, which has a shorter length than the full width of the print medium, in the breadthways direction of the print medium (main scanning direction). The full line head is able to print onto the full area of the printable region of the print medium by scanning once the print medium, by moving the head and the print medium relatively to each other in a sub-scanning direction substantially perpendicular to the width direction of the print medium. Therefore, the full line head is able to print at higher speed than the serial head.

FIGS. 22A, 22B, and 23 show a nozzle arrangement in a full line type print head according to the related art. FIG. 22A is a planar perspective view showing an example of the structure of a print head 500, and FIG. 22B is a planar perspective view showing another example of the structure of a print head 500.

In order to increase the density of the dot pitch printed onto the recording paper and to thereby improve print quality, it is necessary to increase the density of the nozzles by decreasing the nozzle pitch in the print head 500. The print head 500 shown in FIG. 22A achieves an apparent high-density of the nozzles by adopting a structure in which a plurality of ink chamber units 53 are arranged in a matrix configuration. Each of the ink chamber units 53 has a pressure chamber 52, whose planar shape is a substantially square and which is provided with a nozzle 51 and a supply port 54 at the respective corners on a diagonal of the planar shape thereof.

Moreover, as shown in FIG. 22B, it is also possible to use short heads 500' that are arranged in a two-dimensional and staggered fashion, and are combined with each other, whereby the head can have a length corresponding to the full width of the print medium.

FIG. 23 shows the details of a nozzle arrangement shown in FIGS. 22A and 22B.

According to FIG. 23, the nozzles 51 are arranged in a lattice fashion in accordance with a uniform arrangement pattern following a row direction aligned in the main scanning direction, and an oblique column direction having a prescribed non-perpendicular angle θ' with respect to the main scanning direction. By adopting a structure wherein a plurality of ink chamber units 53 are arranged at a uniform pitch d in a direction having an angle θ with respect to the main scanning direction, the pitch P0 of the nozzles projected to align in the main scanning direction (hereinafter referred to as projected nozzle pitch in the main scanning direction) will be $d \times \cos\theta$.

More specifically, concerning the main scanning direction, the arrangement can be dealt equivalently to one in which the respective nozzles 51 are arranged in a linear fashion at a uniform pitch P0. By means of this composition, it is possible to achieve a nozzle composition of high density, wherein the nozzle rows projected to align in the main scanning direction reach a total of 2400 nozzles per inch.

Taking one example of the general dimensions of the print head 500 shown in FIGS. 22A, 22B, and 23, the size of the pressure chambers 52 is 700 μm×700 μm, the size of the actuators 58 is 500 μm×500 μm, the pitch P1 between nozzles that are mutually adjacent in the main scanning direction (the pitch between nozzles that eject droplets at the same timing) is 0.846 mm (corresponding to 30 nozzles per inch (npi)), the nozzle-to-nozzle pitch in the sub-scanning direction is 1 mm, and the ink viscosity used generally for the print head is 2 cp to 3 cp. Regarding the print head having such a structure, a variety of inventions have been suggested in order to increase density of nozzles and/or to improve printing quality.

In the inkjet printer described in Japanese Patent Application Publication No. 2002-166543, pressure chambers are formed to an approximate diamond shape or an approximate rectangular shape, in such a manner that a large number of ink pressure chambers corresponding to a plurality of nozzles can be arranged within the head of the inkjet printer.

In the inkjet head described in Japanese Patent Application Publication No. 2001-334661, the planar shape of the surface on which a pressurization plate of a chamber is arranged is defined to be an approximate square shape or an approximate diamond shape, in such a manner that the chambers are arranged at a high density.

In a head assembly method for a line type inkjet printer described in Japanese Patent Application Publication No. 2002-337320, matrix type heads are arranged adjustably in a staggered matrix fashion, in such a manner that printing errors corresponding to the joints between the heads are avoided.

In the inkjet recording apparatus described in Japanese Patent Application Publication No. 7-17034, recording heads in which the nozzles are driven in a split fashion are installed in a staggered fashion in the main body of the recording apparatus in such a manner that the boundaries for split driving of the nozzles do not overlap with each other. The optical density distributions of the images formed by the respective recording heads are mutually superimposed in such a manner that unevenness in density are alleviated and high image quality can be obtained.

In the inkjet printer apparatus and the print head unit described in Japanese Patent Application Publication No. 8-25635, in a long inkjet printer head formed by connecting together a plurality of heater boards, the heater boards are arranged in a staggered relationship at a prescribed distance apart in one uniform direction, in such a manner that unevenness in density occurring in regions corresponding to the boundaries between heater boards is reduced.

Next, the problems of the related art are described with reference to FIGS. 24 to 27.

FIG. 24 shows the relationship between the nozzle arrangement and the droplet ejection timing in a print head according to the related art. The numbers stated inside the circle indicating nozzles 51 show the droplet ejection timing, and at timing t1, droplets are ejected from the nozzles 51-11, 51-21, and so on, marked with the number 1. Then, at timing t2, droplets are ejected from the nozzles 51-12, 51-22, and so on, marked with the number 2. In this way, at timings t3 to t6, droplets are ejected from the corresponding nozzles, 51-13, 51-23, . . . , 51-16, 51-26, . . . , marked with numbers 3 to 6. In this way, droplet ejection is performed repeatedly from the nozzles marked 1 to 6 in sequence from the timings t1 to t6, and one line of a dot row is formed in the main scanning direction on the recording paper 16 by one cycle of droplet ejection in which the droplets are ejected successively from the nozzles marked 1 through to the nozzles marked 6.

Furthermore, in FIG. 24, the symbol P0 indicates the pitch between nozzles that eject droplets to form dots that are mutually adjacent in the main scanning direction. P1 indicates the pitch between nozzles that are mutually adjacent in the main scanning direction (in other words, the pitch between nozzles that eject droplets at the same timing, and the pitch between nozzle 51-16 and nozzle 51-26 in FIG. 24, for example). P2 indicates the pitch between return positions (nozzle row joint sections) (the interval or pitch between return positions that are mutually adjacent when the return positions A are projected to align in the main scanning direction).

The "return position A" is a boundary (joint section) of nozzle rows, each of which is formed by six nozzles aligned in an oblique direction (for example, the nozzles 51-11 to 51-16). In FIG. 24, for instance, the "return position A" corresponds to a region where the pitch in the sub-scanning direction between the nozzles forming dots that are mutually adjacent in the main scanning direction, such as the pitch between nozzle 51-16 and nozzle 51-21 and the pitch between nozzle 51-26 and nozzle 51-31, is greater than the pitch between other nozzles.

FIG. 25A shows a situation where an ink droplet 501 ejected from the nozzle 51-11 at the timing t1 shown in FIG. 24 and an ink droplet 502 ejected from the nozzle 51-12 at the timing t2 shown in FIG. 24 have landed on the recording paper 16. FIG. 25B shows the cross-sectional shape (the cross-sectional shape in the main scanning direction) of the liquid droplets that have landed on the recording paper 16 as shown in FIG. 25A. The reference symbol 511 shown in FIG. 25B indicates an ink droplet (a dot) ejected from the nozzle 51-21 at the timing t1.

As shown in FIG. 25A, the ink droplet 501 ejected from the nozzle 51-11 at the timing t1 lands independently on the recording paper 16, and therefore, no other ink droplets that have already landed on the recording paper 16 affect the ink droplet 501. Consequently, a dot is formed to the original size, at the original landing position d1. In contrast, when the ink droplet 502 ejected from the nozzle 51-12 at the timing t2 is deposited onto the recording paper 16, it is attracted toward the ink droplet 501 (in the direction indicated by the arrow K), due to landing interference (deposition interference) with the ink droplet 501 that has been deposited previously. As a result, a dot is formed at a position d2' that is shifted toward the ink droplet 501 with respect to the original landing position d2.

In other words, although the pitch (distance) between the dot formed by the ink droplet 501 and the dot formed by the ink droplet 502 is originally intended to be the substantially same as the nozzle pitch P0 between the nozzle 51-11 and the nozzle 51-12, the pitch (distance) between the dot formed by the ink droplet 501 and the dot formed by the ink droplet 502 is in fact a distance of P0'that is smaller than P0 due to the landing interference (aggregation).

Furthermore, the dot formed by the ink droplet 501 absorbs liquid from the ink droplet 502, and therefore, the dot formed by the ink droplet 501 is formed to a greater size than the original size and also has a higher thickness than the original thickness. On the other hand, the dot formed by the ink droplet 502 is formed to a smaller size than the original size, and the thickness of the dot formed by the ink droplet 502 is lower than the original thickness.

Similarly, due to landing interference with an adjacent droplet that has been deposited previously, the ink droplets ejected at the timing t2 to the timing t5 form dots in positions that are near the previously deposited ink droplet compared to their respective original landing positions.

On the other hand, as shown in FIGS. 26A and 26B, the ink droplet 506, which is ejected from the nozzle 51-16 (the nozzle corresponding to the return position) at the timing t6, lands between the ink droplet 505 ejected from the nozzle 51-15 at the timing t5 and the ink droplet 511 ejected from the nozzle 51-21 at the timing t1. Hence, the ink droplet 506 is attracted by both the ink droplet 505 and the ink droplet 511.

More specifically, the ink droplet 506 forms a dot at a position d6' where the forces of attraction from the ink droplet 505 and the ink droplet 511 are balanced. Provided that the ink droplet 505 and the ink droplet 511 exert substantially the same force of attraction on the ink droplet 506, then the dot is formed in the original landing position by the ink droplet 506.

If the ink droplet 506 forms a dot at an intermediate position between the ink droplet 505 and the ink droplet 511, then the dot pitch P0" between the dot formed by the ink droplet 506 and the dot formed by the ink droplet 505, and the dot pitch P0" between the dot formed by the ink droplet 506 and the dot formed by the ink droplet 511 will be greater than the dot pitch P0' between the respective dots formed by the ink droplets 501 to 505 (in FIGS. 26A and 26B, this corresponds to the dot pitch between the dot formed by the ink droplet 504 ejected at the timing t4, and the dot formed by the ink droplet 505) (i.e., P0'<P0").

Thus, in the nozzle arrangement shown in FIGS. 22A, 22B, and 23, variation arises in the dot pitches when printing is performed at the regions corresponding to the return position A shown in FIG. 24, and highly conspicuous unevenness in the resulting image may arise in the sub-scanning direction as a result of this variation in the dot pitch. Due to the effect of the peculiarity in landing interference at the regions corresponding to the return position A, the return positions form a peculiar point in the landing interference, and therefore, striped unevenness or non-uniform density is liable to occur in the sub-scanning direction.

FIG. 27 shows a visibility curve 600. The visibility curve 600 shows the boundaries of visibility of uneven density, wherein the horizontal axis denotes the spatial frequency and the vertical axis denotes the density differential (ΔD). In the region above the visibility curve 600, unevenness in density is readily visible, and in the region below the visibility curve 600, unevenness in density is not readily visible. The value lp/mm (line pair/millimeter) indicates the number of dark and light shades per unit length (the number of sets of dark and light shading per unit length).

According to this visibility curve 600, the visibility of uneven density is particularly high at 30 npi to 50 npi (1.2 lp/mm to 2.0 lp/mm), and hence it is especially prominent in the intermediate density region when an image of high density and high quality is formed. According to the general dimensions of the print head 500 described above, the nozzle pitch P1 between nozzles that are adjacent in the main scanning direction is 0.846 mm, which corresponds to around 1.2 lp/mm when converted to the spatial frequency. Hence, the visibility of uneven density is high when the dots are formed by the ink droplets ejected at an interval of P1. In particular, due to the peculiarity at the regions corresponding to the return positions A, it is difficult to increase the spatial frequency of the uneven density to high frequency level of which the visibility is low.

Moreover, although accuracy to approximately 1 μm is required in the diameter and positioning of the nozzles having an aperture diameter of 30 μm, the striped unevenness is liable to become even more conspicuous at the return positions A because lack of continuity in the manufacturing process is liable to arise. This is because the nozzle pitch P02 between the nozzles on both sides of the return position A shown in FIG. 24 is different to the nozzle pitch P0 in other sections, and/or there is disparity in the nozzle diameter. Furthermore, in order to increase yet further the density of the nozzle rows obtained by projecting the nozzles to align in the main scanning direction, it is necessary to increase the number of the nozzles aligned in the main scanning direction. There are possibilities that manufacturing variations will increase in the head overall, while production yield declines.

In the inkjet printer described in Japanese Patent Application Publication No. 2002-166543 and the inkjet head described in Japanese Patent Application Publication No. 2001-334661, the nozzle density is 30 npi to 50 npi, since the actual size of the pressure chamber is approximately 300 μm to 500 μm. If this head is to be used as a line head for high image quality, in particular, then a matrix arrangement of 10 to 20 rows, or greater, (namely, 300 npi to 1000 npi, or greater), is required. Accordingly, a level of difficulty of manufacturing a large head with the nozzles arranged in a high density is raised.

Furthermore, the image forming apparatus described in Japanese Patent Application Publication No. 2002-337320 discloses split adjustment of the head for the purpose of improving the overall production yield and the maintenance performance. However, this splitting of the head is made in the main scanning direction, and the application does not disclose an effective method for achieving high density by means of a matrix arrangement.

Furthermore, the inkjet recording apparatus described in Japanese Patent Application Publication No. 7-17034, and the inkjet printer apparatus and print head unit described in Japanese Patent Application Publication No. 8-25635 have compositions in which joint positions are staggered in relation to respective colors, and beneficial effects will not be expected in monochrome printing.

SUMMARY OF THE INVENTION

The present invention has been contrived in view of the foregoing circumstances, and it is an object of the invention to provide an ejection head, an image forming apparatus, and an image forming method that reduce unevenness that can be generated when printing corresponding to a return position of a head having nozzles arranged in a matrix configuration is performed, whereby desirable print quality is achievable.

In order to attain the aforementioned object, the present invention is directed to an ejection head, comprising: n (where n is an integer not less than 2) pieces of ejection aperture groups arranged in a sub-scanning direction, each of the groups including ejection aperture rows arranged at prescribed intervals in a main scanning direction, each of the ejection aperture rows including a plurality of ejection apertures aligned in an oblique direction with a prescribed angle θ (where $0°<\theta<90°$) with respect to the main scanning direction, wherein: the ejection aperture groups are arranged in such a manner that phases of the ejection aperture groups disposed adjacently in the sub-scanning direction are varied in the main scanning direction so that, in projected ejection aperture rows that are obtained by projecting the ejection apertures of each of the ejection aperture groups to dispose the ejection apertures in the main scanning direction, one of the ejection apertures in one of the groups arranged adjacently in the sub-scanning direction is located between the adjacent ejection apertures in the other of the ejection aperture groups.

In an ejection head according to the related art, the displacement of the dot in the main scanning direction on ejection receiving medium due to landing interference (droplet deposition interference) tends to take place because of the peculiarity at a return position corresponding to a joint section of ejection aperture rows. According to the present invention, the displacement of the dot in the main scanning direction due to the landing interference (droplet deposition interference) is restrained, and hence the occurrence of striped unevenness and non-uniform density occurring in the sub-scanning direction can be reduced.

There is an embodiment according to the present invention that the main scanning direction is a direction substantially perpendicular to the relative conveyance direction of the ejection receiving medium and the ejection head, when liquid droplets are ejected onto the full printable region of the ejection receiving medium during relative displacement of the ejection receiving medium and a full line type ejection head comprising a plurality of ejection heads provided along a length corresponding to the full width of the printable range of the ejection receiving medium.

On the other hand, there is another embodiment according to the present invention that the sub-scanning direction is a direction perpendicular to the main scanning direction, and hence the relative conveyance direction of the ejection receiving medium and the ejection head may be taken as the sub-scanning direction.

The ejection head may be a full line type ejection head in which the ejection apertures for ejecting liquid droplets are arranged in the range of a length corresponding to the entire printable width of the ejection receiving medium. In addition, the ejection head may be a serial type ejection head (shuttle scanning type ejection head) in which a short head having ejection apertures for ejecting liquid droplets arranged in the range of a length that is shorter than the entire width of the ejection receiving medium ejects liquid droplets onto the ejection receiving medium while scanning in the width direction of the ejection receiving medium is performed.

The arrangements of the ejection apertures in the ejection aperture groups may be same, and may be different. All the ejection aperture groups can be provided with the single ejection head. Furthermore, a plurality of the ejection heads, each of which has the single ejection aperture group or has the plurality of ejection aperture groups, may be provided.

Preferably, the number (n) of the ejection aperture groups is even number; and the ejection aperture groups are arranged at different phases in the main scanning direction, in such a manner that, taking return positions to be positions that are boundaries between the ejection aperture rows, arranged adjacently in the main scanning direction, of the ejection aperture rows in the ejection aperture groups as well as where a pitch between the ejection apertures in the sub-scanning direction is greater than other pitches between other ejection apertures, pitches between the return positions projected to align in the main scanning direction are uniform.

According to the present invention, the phases concerning the ejection aperture groups are staggered in the phase in the main scanning direction, in such a manner that the pitches between the return positions are uniform when the nozzles are projected to align in the main scanning direction. Hence, the spatial frequency of the striped unevenness, caused by the aggregation of liquid on the basis of the regions corresponding to the return positions that form a peculiar point in respect of the difference between landing times, occurring on the image formed on the ejection receiving medium can be increased, and the cycle of striped unevenness can be even. Therefore, the striped unevenness becomes less perceptible.

The return positions, where the pitch between the ejection apertures in the sub-scanning direction is greater than in other parts, correspond to the joint positions (joint sections) between nozzle rows that are arranged adjacently in the main scanning direction.

If the droplet flight time from the ejection by the nozzle to the touchdown on the ejection receiving medium is considerable short compared to landing-time differences between ink droplets, then the landing-time difference is equivalent to the ejection-time difference.

The image (three-dimensional shape) here comprehends subjects formed on the ejection receiving medium by the droplets landing on the ejection receiving medium, such as a photo image, a picture, a pattern, a letter, a figure, a patterned shape (e.g. a wiring pattern on a wiring board).

Preferably, the ejection apertures are arranged so as to be arranged at different locations in the projected ejection aperture row.

Furthermore, it is preferable that the ejection apertures are arranged so that the pitches between the ejection apertures in the projected ejection aperture row are equal.

In order to attain the aforementioned object, the present invention is also directed to the above-described ejection head; and an ejection controller which controls the image forming apparatus to form a dot row in the main scanning direction on an ejection receiving medium in such a manner that, droplets are ejected from the ejection head so that when a droplet ejected from one of the ejection apertures lands on the ejection receiving medium, droplets that are, with the exception of on ends of the dot row, adjacent to the droplet ejected from the one of the ejection apertures have already been present on both sides of the droplet or have not been present on both sides of the droplet.

According to the present invention, if the surface area coverage rate of the dots formed by the liquid droplets ejected onto the ejection receiving medium is high, as in a (full-surface) solid image, or the like, then there are liquid droplets that are ejected onto a landing position where there is no interference with other liquid droplets, and liquid droplets that are ejected onto a landing position where there are previously deposited liquid droplets in adjacent positions on both sides in the main scanning direction. Hence, displacement of the dot forming position in the main scanning direction due to the landing interference is restrained, and the striped unevenness and non-uniform density, occurring on the image formed on the ejection receiving medium, can be reduced.

The image forming apparatus comprehends an ink jet recording device forming a desired image by ejecting ink droplets onto the ejection receiving medium (recording medium).

Preferably, the number (n) of the ejection aperture groups is even number; and the ejection aperture groups are arranged at different phases in the main scanning direction, in such a manner that, taking return positions to be positions that are boundaries between the ejection aperture rows, arranged adjacently in the main scanning direction, of the ejection aperture rows in the ejection aperture groups as well as where a pitch between the ejection apertures in the sub-scanning direction is greater than other pitches between other ejection apertures, pitches between the return positions projected to align in the main scanning direction are uniform.

According to the present invention, the visibility of striped unevenness extending in the sub-scanning direction on the record image can be reduced and the degradation of the image quality can be restrained, because of the peculiarity at the regions corresponding to the return positions.

Preferably, the image forming apparatus further comprises: a conveyance device which moves the ejection receiving medium relatively with respect to the ejection head by conveying at least one of the ejection head and the ejection receiving medium, wherein the ejection controller controls the image forming apparatus so that one dot row is formed in the main scanning direction on the ejection receiving medium, by means of one cycle of ejection in which ejection is performed sequentially from the ejection aperture on an uppermost side in direction of relative movement of the ejection receiving medium until the ejection aperture on an lowermost side in the direction of the relative movement, while at least one of the ejection head and the ejection receiving medium onto which the droplets are ejected from the ejection head is moved in the sub-scanning direction.

The one cycle of droplet ejection here means the smallest unit of an ejection operation that forms one dot row in the main scanning direction. There is a mode of the one cycle of droplet ejection that all of the ejection apertures in the ejection aperture row arranged in the oblique direction with respect to the main scanning direction are driven in a prescribed sequence (timing). Apart of the ejection apertures in the ejection aperture row may be switched off at the prescribed timing.

Preferably, the ejection aperture groups are arranged at different phases in the main scanning direction in such a manner that, maximum value $\delta Tmax1$ of adjacent-landing-time differences between adjacent landing times concerning the ejection apertures that eject the droplets to form the dots being mutually adjacent in the main scanning direction, and maximum value $\delta Tmax2$ of landing-time differences between landing times concerning the ejection apertures in the ejection head satisfy the following relationship: $\delta Tmax1<\delta Tmax2$.

According to the present invention, the phases of the ejection aperture groups are staggered in the main scanning direction in such a manner that the maximum value, $\delta Tmax1$, of the difference between adjacent landing times concerning the ejection apertures forming the dots that are mutually adjacent in the main scanning direction is not equal to the maximum value, $\delta Tmax2$, of the difference between the landing times concerning the ejection apertures in the ejection head. Therefore, it is possible to reduce the striped unevenness occurring on the image due to aggregation of the ink droplets being on the ejection receiving medium.

Preferably, the ejection aperture groups are arranged at different phases in the main scanning direction in such a manner that, minimum value $\delta Tmin1$ of adjacent-landing-time differences between the landing times concerning the ejection apertures that eject the droplets to form the dots being mutually adjacent in the main scanning direction, and maximum value $\delta Tmax1$ of the adjacent-landing-time differences satisfy the following relationship: $\delta Tmin1/\delta Tmax1 \geqq \mathbf{0.5}$.

According to the present invention, it is possible to reduce the striped unevenness occurring due to aggregation by ensuring that the ratio of the minimum value of the adjacent-landing-time differences to the maximum value of the adjacent-landing-time differences is not more than a prescribed ratio in such a manner that the variations of the landing-time differences concerning the ejection apertures that form adjacent dots in the main scanning direction is low. It is more preferable that an embodiment satisfies $\delta Tmax/\delta Tmax2 \geqq 0.25$.

The intervals between the ejection aperture groups in the sub-scanning direction may be varied so as to satisfy the relationship between the maximum value $\delta Tmax1$ of the adjacent-landing-time differences and the maximum value $\delta Tmax2$ of the landing-time differences between the ejection apertures in the head as defined above, and the relationship between the maximum value and minimum value of the adjacent-landing-time differences as defined above.

Preferably, the ejection head is a full line type ejection head comprising at least one set of the plurality of ejection apertures aligned in a range of a length corresponding to an entire printable width of the ejection receiving medium.

The full line ejection head may be formed to a length corresponding to the full printable width of the ejection receiving medium by combining short head having rows of ejection apertures that do not reach the length corresponding to the full printable width of the ejection receiving medium, these short heads being joined together in a staggered matrix fashion.

In order to attain the aforementioned object, the present invention is also directed to an image forming method for forming an image on an ejection receiving medium, by ejecting droplets onto the ejection receiving medium from an ejection head having ejection apertures for ejecting the droplets, the image forming method comprising the steps of: ejecting the droplets from the ejection head; and conveying at least one of the ejection head and the ejection receiving medium so that the ejection receiving medium is moved relatively with respect to the ejection head, wherein the droplets are ejected from the ejection head so that when a droplet ejected from one of the ejection apertures lands on the ejection receiving medium, droplets that are, with the exception of on ends of the dot row, adjacent to the droplet ejected from the one of the ejection apertures have already been present on both sides of the droplet or have not been present on both sides of the droplet.

According to the present invention, beneficial effects can be expected if the dots are formed densely on the ejection receiving medium, in particular, as in the case of a (full-surface) solid image, or the like.

According to the present invention, an ejection head comprises n ejection aperture groups (where n is an integer number of not less than 2) arranged in a sub-scanning direction, each of the groups including ejection aperture rows arranged at prescribed intervals in a main scanning direction, and each of the ejection aperture rows including a plurality of ejection apertures aligned in an oblique direction with a prescribed angle $\theta$ (where $0° < \theta < 90°$) with respect to the main scanning direction; wherein, the phases of the ejection aperture groups is varied in the main scanning direction so that the nozzle-to-nozzle pitches in the projected ejection aperture rows are mutually interpolated. Hence, the displacement of the dot-form-position in the main scanning direction occurring due to landing interference and striped unevenness occurring in the sub-scanning direction can be reduced when the surface area coverage rate of the dots formed by the liquid droplets ejected onto the ejection receiving medium is high, as in the case of a (full-surface) solid image, or the like.

In particular, if the present invention is applied to the return positions where the pitch between ejection apertures in the sub-scanning direction is greater than other pitches, it is possible to improve the peculiarity in the landing interference at the regions corresponding to the return positions, and hence the visibility of striped unevenness occurring at the regions corresponding to the return positions can be reduced.

Furthermore, the present invention is effective with respect to lack of continuity in the processing of ejection apertures corresponding to the return positions.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
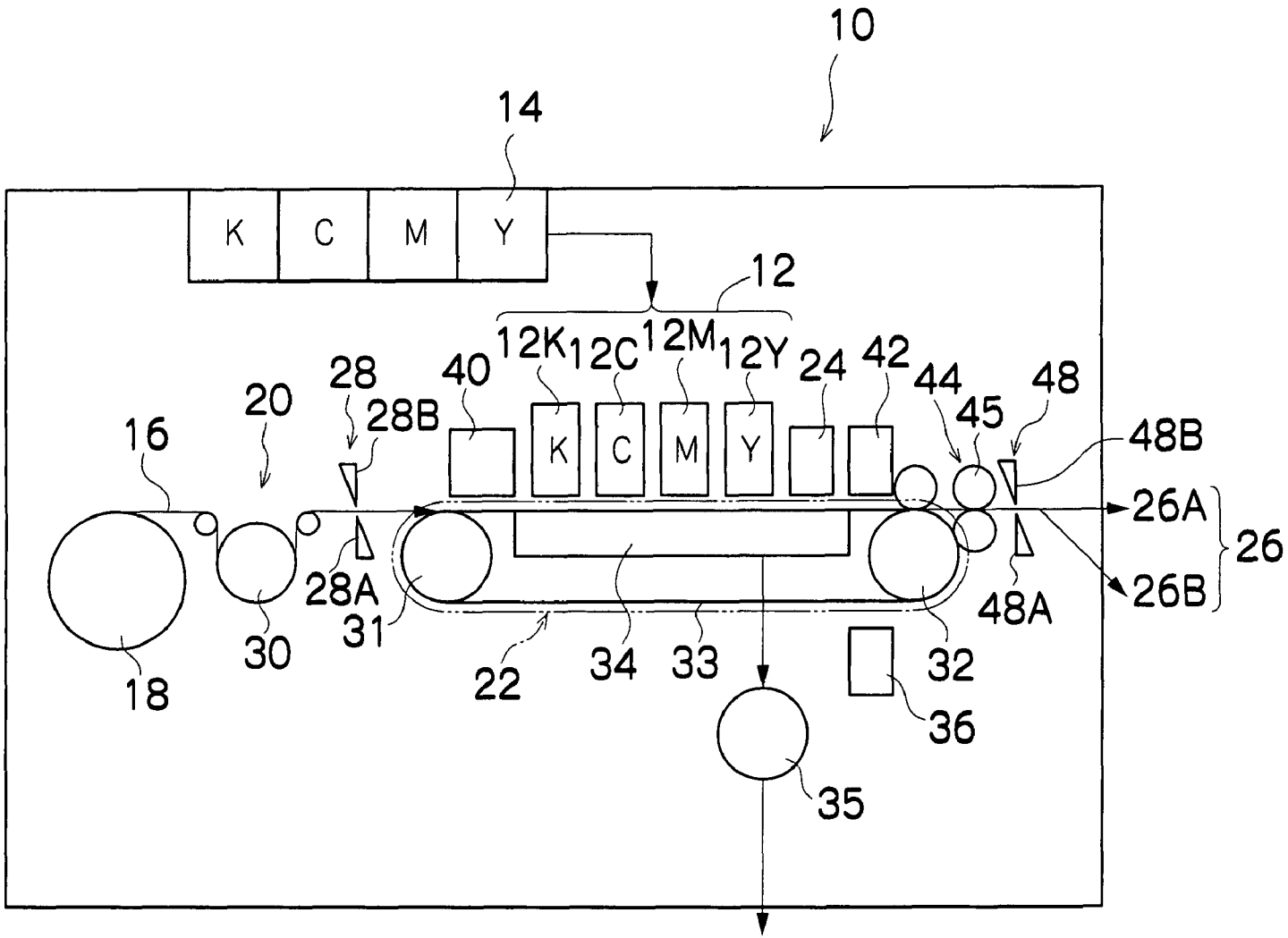
FIG. 1 is a basic compositional diagram of an inkjet recording apparatus installed with a print head according to an embodiment of the present invention.

FIG. 1 is a diagram of the general composition of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. In this, the heating temperature is preferably controlled in such a manner that the recording paper 20 has a curl in which the surface on which the print is to be made is slightly rounded in the outward direction.

In the case of the configuration in which roll paper is used, a cutter (a first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

After the decurling process, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and this suction chamber 34 provides suction with a fan 35 to generate a negative pressure, thereby holding the recording paper 16 onto the belt 33 by suction.

The belt 33 is driven in the clockwise direction in FIG. 1 by the motive force of a motor (not shown in FIG. 1, but shown as a motor 88 in FIG. 8) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of a suction belt conveyance unit 22, it might also be possible to use a roller nip conveyance mechanism, but since the print region passes through the roller nip, the printed surface of the paper makes contact with the rollers immediately after printing, and hence smearing of the image is liable to occur. Therefore, a suction belt conveyance mechanism in which nothing comes into contact with the image surface in the printing area, as the present embodiment, is preferable.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after landing on the paper.

Figure 2:
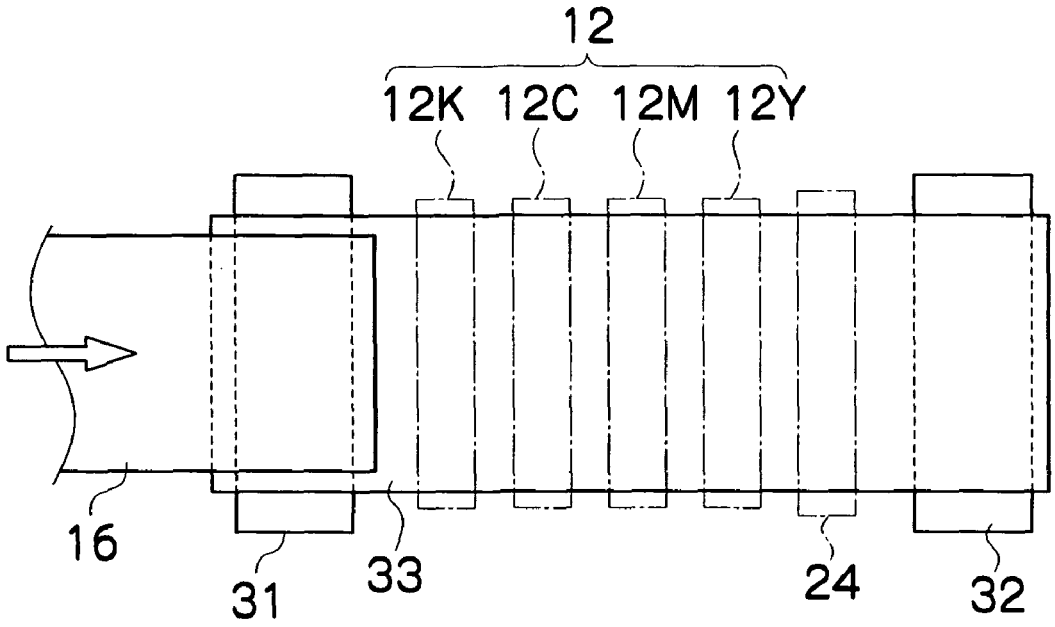
FIG. 2 is a plan view of the principal part of the peripheral printing region of the inkjet recording apparatus shown in FIG. 1.

The print unit 12 is a so-called "full line head" in which a line head having a length corresponding to the maximum paper width is arranged in a direction (main scanning direction) that is perpendicular to the paper feed direction (see FIG. 2). An example of the detailed structure is described below (in FIG. 3 to FIG. 5), but each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side, following the feed direction of the recording paper 16 (hereinafter, referred to as the sub-scanning direction). A color print can be formed on the recording paper 16 by ejecting the inks from the print heads 12K, 12C, 12M, and 12Y, respectively, onto the recording paper 16 while the recording paper 16 is conveyed.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with four standard colors, K, C, M and Y is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of K, C, M and Y to be supplied to the print heads 12K, 12C, 12M, and 12Y, and the tanks are connected to the print heads 12K, 12C, 12M, and 12Y by means of channels (not shown). The ink storing and loading unit 14 has a warning device (for example, a display device and/or an alarm sound generator) for warning when the remaining amount of any ink is low, and has a mechanism for preventing loading errors among the colors.

The print determination unit 24 includes an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged in a two-dimensional fashion.

The print determination unit 24 reads a test pattern image printed by the print heads 12K, 12C, 12M, and 12Y for the respective colors, and determines the ejection of each head. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Next, the structure of the print head will be described. The print heads 12K, 12C, 12M and 12Y of the respective ink colors have the same structure, and a reference numeral 50 is hereinafter designated to any of the print heads.

Figure 3:
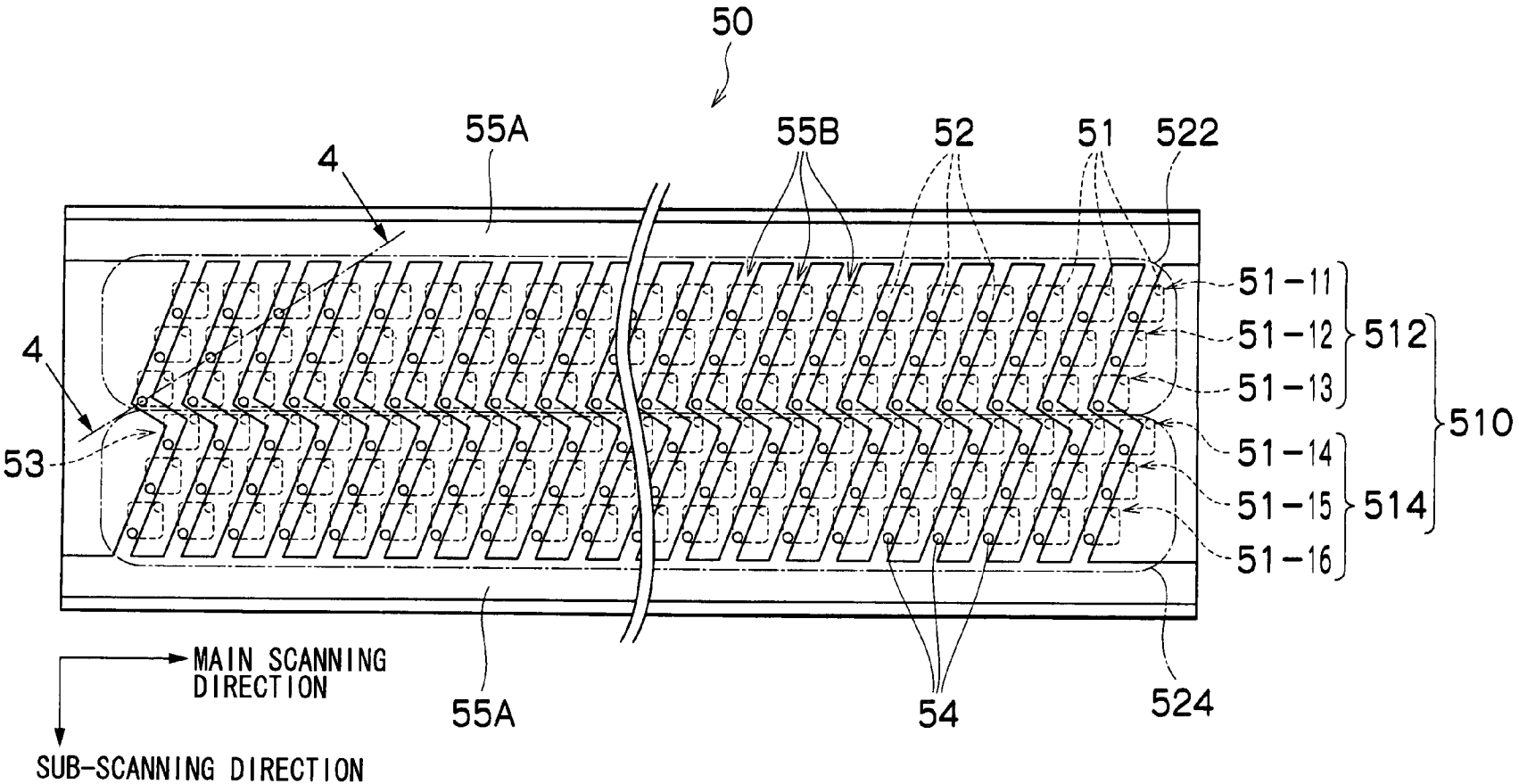
FIG. 3 is a planar perspective view showing an example of the composition of a print head.
Figure 4:
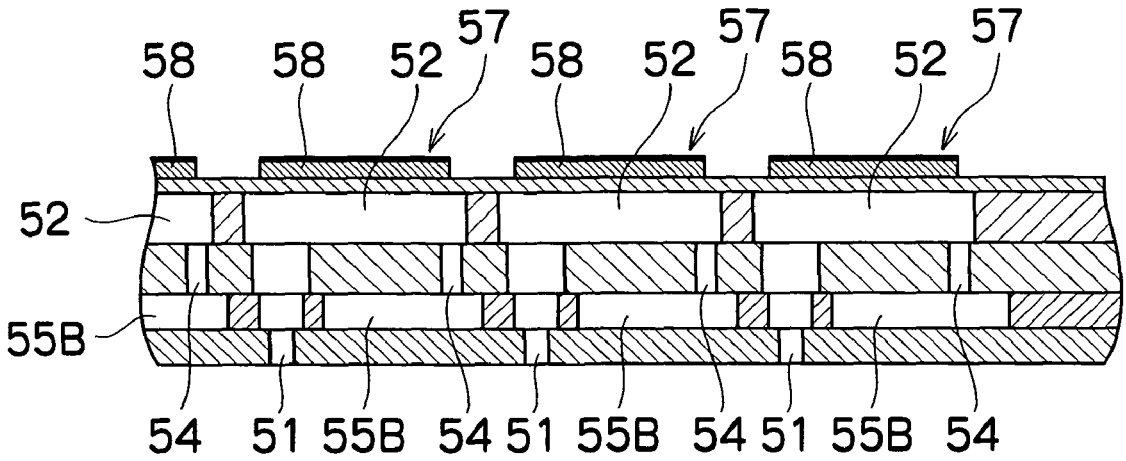
FIG. 4 is a cross-sectional view along line 4-4 in FIG. 3.

FIG. 3 is a planar perspective view showing an example of the structure of the print head 50, and FIG. 4 is a cross-sectional view showing the three-dimensional composition of an ink chamber unit (a cross-sectional view along line 4-4 in FIG. 3).

In order to achieve a high density of the dot pitch printed onto the surface of the recording medium, it is necessary to achieve a high density of the nozzle pitch in the print head 50. As shown in FIGS. 3A, 3B, and 4, the print head 50 according to the present embodiment has a structure in which a plurality of ink chamber units 53 including nozzles 51 for ejecting ink droplets and pressure chambers 52 corresponding to the nozzles 51 are disposed in the form of a staggered matrix, and the effective nozzle pitch is thereby made small and has a high density structure.

More specifically, as shown in FIG. 3, the print head 50 according to the present embodiment is a full-line head having one or more nozzle rows in which a plurality of nozzles 51 for ejecting ink are arranged in the rage of a length corresponding to the entire width of the recording medium in a direction substantially perpendicular to the conveyance direction of the recording medium.

As shown in FIG. 3, the nozzles 51 (ink chamber units 53) provided in the print head 50 are arranged in a lattice fashion in accordance with a uniform arrangement pattern following a row direction aligned in the main scanning direction, and in an oblique column direction having a prescribed non-perpendicular angle with respect to the main scanning direction.

Figure 22A:
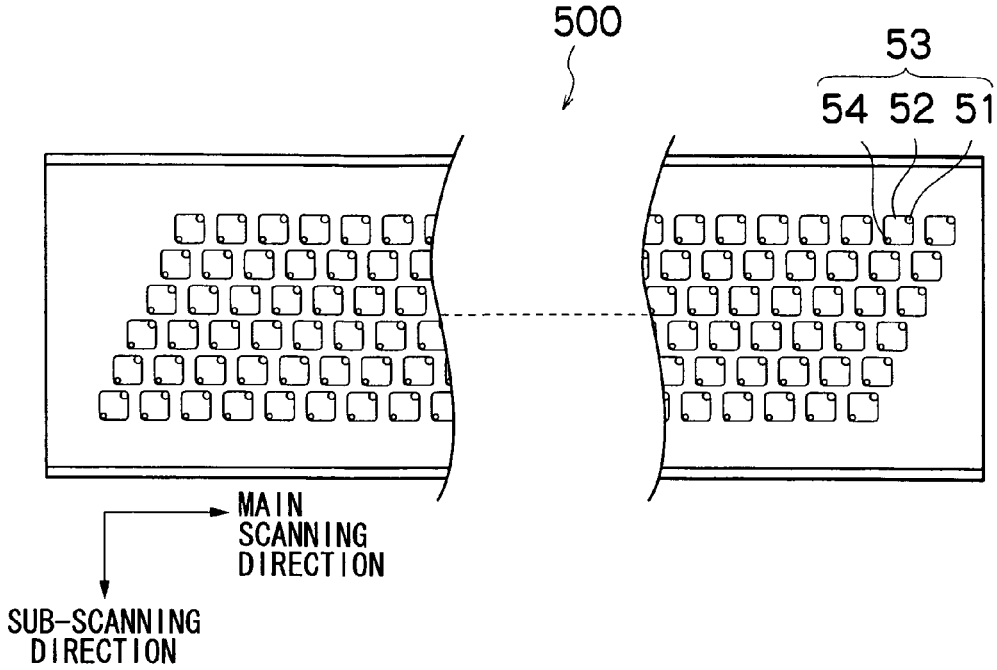
FIG.22A RELATED ART
FIGS. 22A and 22B are planar perspective views showing the nozzle arrangement of a print head according to the related art.
Figure 22B:
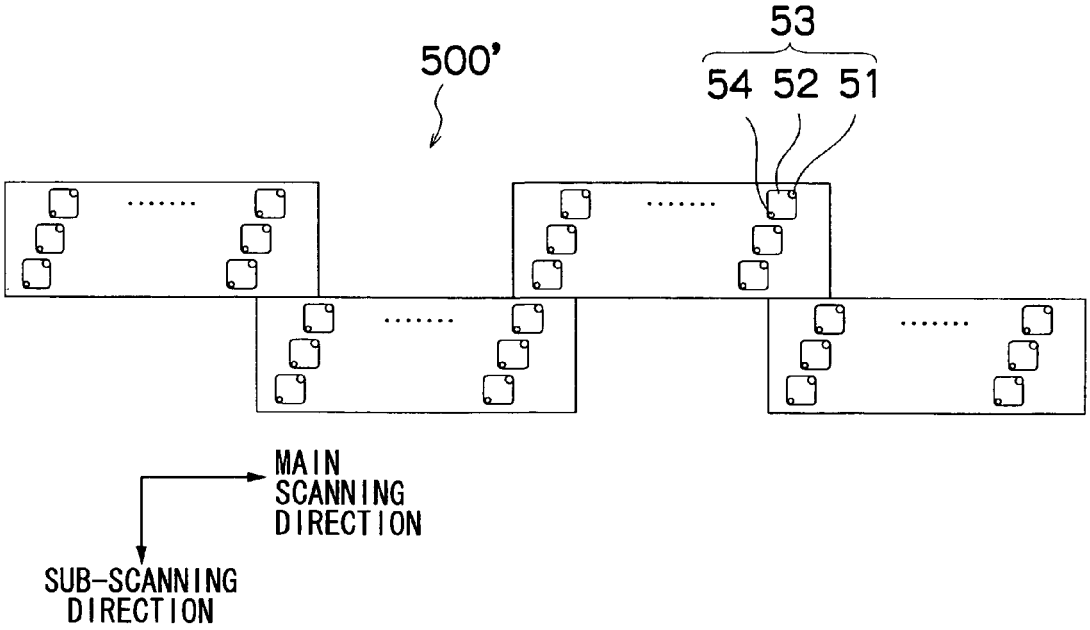
FIG.22B RELATED ART

According to the related art, the nozzle row 510 shown in FIG. 22A are formed with the six nozzles aligned in line in the print head 500. In contrast, in the print head 50 shown in FIG. 3 according to the present embodiment, the nozzle row is split into a nozzle row 512 comprising nozzles 51-11, 51-12 and 51-13, and a nozzle row 514 comprising nozzles 51-14, 51-15 and 51-16. Furthermore, the nozzle row 512 and the nozzle row 514 are arranged in staggered phase in the main scanning direction, and the position of the nozzle row 512 and the position of the nozzle row 514 are out of alignment.

More specifically, each of the nozzle rows 510 arranged in an oblique direction and comprising six nozzles is split into two parts, namely, the nozzle row 512 and the nozzle row 514. Each of the nozzle row 512 and the nozzle row 514 has three nozzles arranged in the sub-scanning direction, and the nozzle rows 512 and 514 are positioned in a staggered phase in the main scanning direction. The structures of the other nozzle rows, which are arranged in the main scanning direction, are similar to those of nozzle rows 512 and 514.

In other words, in the print head 50, the nozzles 51 are split into two groups in the sub-scanning direction, namely, a nozzle group 522 including a plurality of nozzle rows aligned in parallel with the nozzle row 512 in the main scanning direction, and a nozzle group 524 including a plurality of nozzle rows aligned in parallel with the nozzle row 514 in the main scanning direction. The one nozzle group (for example, nozzle group 522) and the other nozzle group (for example, nozzle group 524) are positioned in a staggered phase in the main scanning direction.

Furthermore, the phases of the respective nozzle groups in the main scanning direction are determined in such a manner that the nozzle-to-nozzle pitches are uniform in the projected nozzle row obtained by projecting the nozzles 51 of the nozzle group 522 and the nozzle group 524 to align in the main scanning direction.

In the present embodiment, a plurality of nozzles arranged in the oblique direction within a nozzle group is referred to as a nozzle row. Furthermore, a nozzle row, such as nozzle row 510 in FIG. 3, that belongs to the two nozzle groups and functions as one nozzle row in the droplet ejection control procedure is also referred to as a "nozzle row". If the nozzles of the nozzle group 510 are driven in a prescribed sequence, then it is possible to perform one cycle of a droplet ejection (one cycle of an ejection operation).

The one cycle of the droplet ejection means the smallest unit of the droplet ejection operation that forms one dot row in the main scanning direction, and this may involve driving all of the nozzles in a nozzle row arranged in an oblique direction with respect to the main scanning direction, in a prescribed sequence (timing). It is also possible for a portion of the nozzles in the nozzle row to be switched off at the prescribed timing.

Furthermore, the print head 50 comprises an ink supply system having a common flow channel 55 including main flow channels 55A and branch flow channels 55B, and the like. The main flow channels 55A are provided in a two-tiered fashion with an upper row and a lower row, disposed on both sides of the ink chamber units 53 that are arranged in the form of a staggered matrix. The details of the nozzle arrangement in the print head 50 shown in FIG. 3 are described later.

Main supply ports (not shown in FIG. 3 and indicated by reference numeral 108 in FIG. 6) are formed at the left-hand and right-hand ends of the main flow channels 55A, and the main flow channels 55A are connected to the ink supply system (the ink storing and loading unit 14 shown in FIG. 1, and the like) via these main supply ports. The two main flow channels 55A are communicated with the common flow channels 55B that are common to the nozzle rows 512 and 514, ink is supplied from the ink supply system to the pressure chamber 52 via the main flow channels 55A and the common flow channels 55B.

As in the case of the print head 500' shown in FIG. 24B that is explained above as the related art, the print head 50 may also be formed to a length corresponding to the full width of the print medium (recording paper 16) by combining a plurality of short heads 50' that are placed in a two-dimensional fashion and in a staggered arrangement.

The pressure chamber 52 provided corresponding to each of the nozzles 51 is substantially square-shaped in plan view, and a nozzle 51 and a supply port 54 are provided respectively at either corner of a diagonal of the pressure chamber 52. Each pressure chamber 52 is connected via the supply port 54 to the common flow channel (branch flow channel) 55B.

An actuator 58 provided with an individual electrode 57 is joined to a pressure plate 56, which forms the upper face of the pressure chamber 52. The actuator 58 is deformed when a drive voltage is supplied to the individual electrode 57, thereby causing ink to be ejected from the nozzle 51. When ink is ejected, new ink is supplied to the pressure chamber 52 from the common flow passage 55, via the supply port 54.

Figure 5:
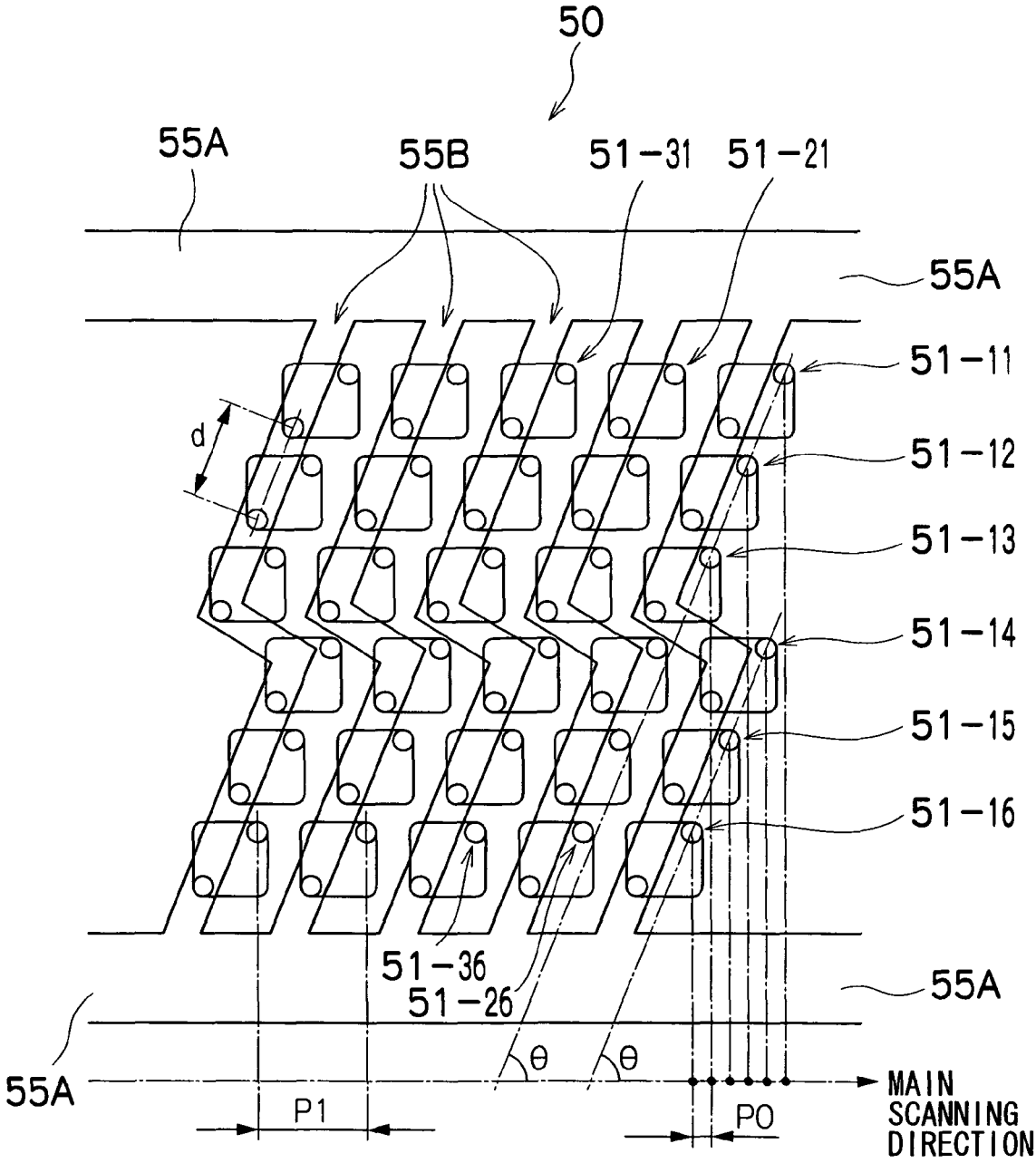
FIG. 5 is an enlarged view showing a nozzle arrangement in the print head shown in FIG. 3.

As shown in FIG. 5, the plurality of ink chamber units 53 having such a structure are arranged in a lattice arrangement, based on a fixed arrangement pattern having a row direction which coincides with the main scanning direction, and a column direction that, rather than being perpendicular to the main scanning direction, is inclined at a fixed angle of $\theta$ with respect to the main scanning direction. By adopting a structure wherein the plurality of ink chamber units 53 are arranged at a uniform pitch d in a direction having the angle $\theta$ with respect to the main scanning direction, the pitch P0 between the nozzles that are projected to align in the main scanning direction is $(d \times \cos\theta)/2$.

More specifically, concerning the main scanning direction, the arrangement can be substantially treated equivalently to one wherein the respective nozzles 51 are arranged in a linear fashion at uniform pitch P. By means of this composition, it is possible to achieve a nozzle composition of high density, wherein the nozzle rows projected to align in the main scanning direction reach a total of 2400 per inch (2400 nozzles per inch). As a matter of convenience for explanation, in the below description, it is supposed that the nozzles 51 are arranged in a linear fashion at a uniform pitch (P0) in the longitudinal direction of the head (main scanning direction).

The standard specifications of the print head 50 according to the present embodiment are the same as the standard specification of the print head 500 according to the related art. Taking one example of the dimensions, the size of the pressure chambers 52 is 700 μm×700 μm, the size of the actuators 58 is 500 μm×500 μm, the pitch P1 between nozzles that are mutually adjacent in the main scanning direction (the pitch between nozzles that eject droplets at the same timing) is 0.846 mm (=30 npi), the droplet ejection interval in the sub-scanning direction is 1 mm, and the ink viscosity of 2 cp to 3 cp is usually used.

In a full-line head comprising rows of nozzles corresponding to the entire width of the image recordable width, the nozzle driving is performed on the basis of, for example, one of the following ways: (1) simultaneously driving all the nozzles; (2) sequentially driving the nozzles from one side toward the other; and (3) dividing the nozzles into blocks and sequentially driving the nozzles from one side toward the other side with respect to each of the blocks. Furthermore, the "main scanning" is defined as the nozzle driving wherein a line formed of one row of dots, or a line formed of a plurality of rows of dots in the width direction of the recording paper (the direction perpendicular to the conveyance direction of the recording paper) is printed.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction on the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of a line (a line formed of a row of dots, or a line formed of a plurality of rows of dots) formed by the main scanning, while the full-line head and the recording paper are relatively displaced to each other.

In implementing the embodiments according to the present invention, the arrangement of the nozzles is not limited to that of the example shown in the drawings. Moreover, a method is employed in the present embodiment where an ink droplet is ejected by means of the deformation of the actuator 58, which is typically a piezoelectric element. However, in implementing the embodiments, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Figure 6:
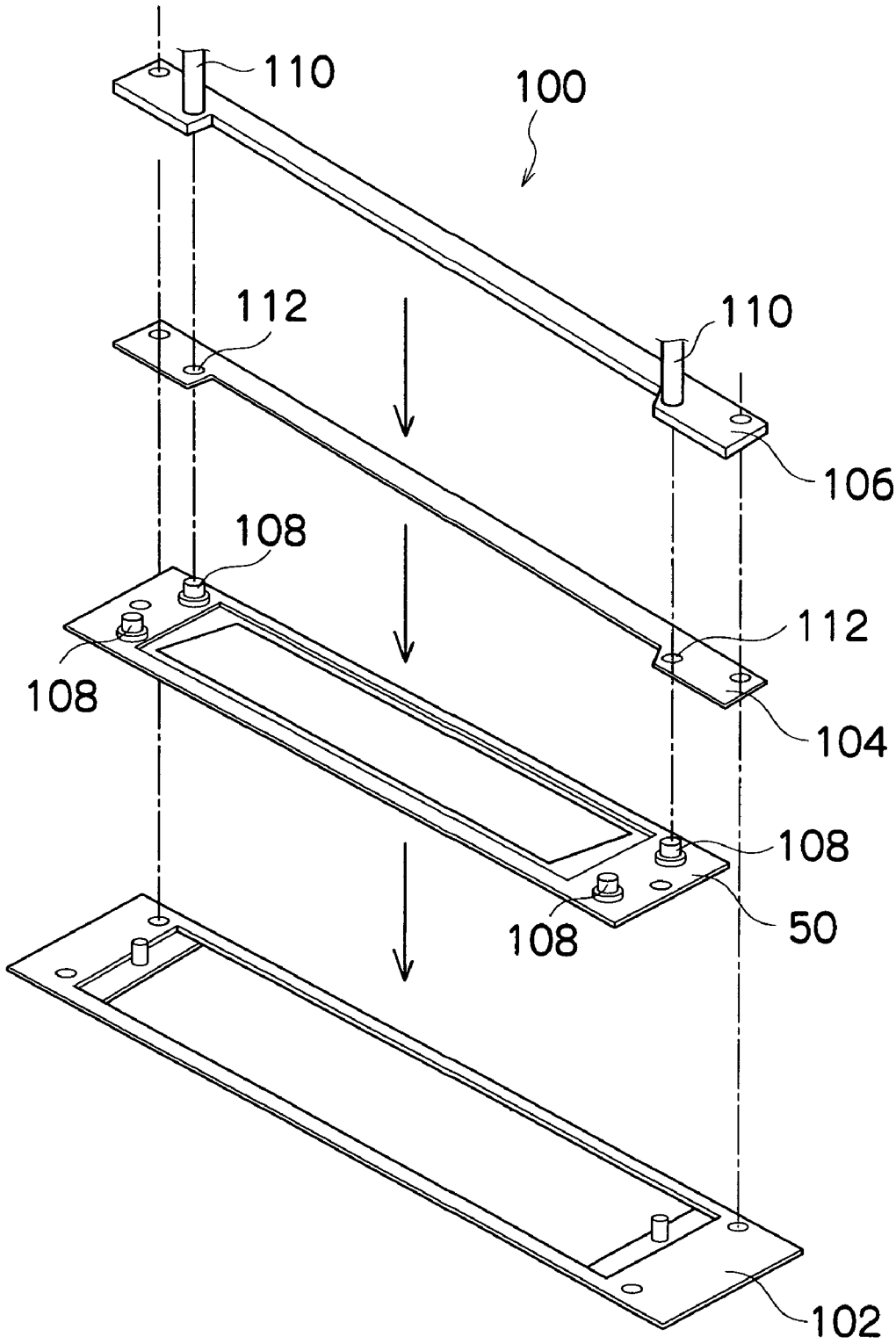
FIG. 6 is a diagram showing a process for assembling a print head according to an embodiment of the present invention.

When a print head 50 having the structure described above is installed in the inkjet recording apparatus 10, a head assembly 100 is installed as shown in FIG. 6. More specifically, the print head 50 is fitted into a holder 102, and then an attachment 104 is sandwiched between the print head 50 and a coupling plate 106 that fixes those.

Reference numeral 108 denotes the main supply port connected to the main flow channel as shown in FIG. 3, and reference numeral 110 denotes an ink channel that connects the ink supply system comprising the ink storing and loading unit 14 shown in FIG. 1 and the like, with the main supply port 108. Furthermore, reference numeral 112 denotes a rubber packing member for preventing ink leakage, which seals the main supply port 108 and the ink channel 110.

Although not shown in the drawings, an attachment 104 and a coupling plate 106 are also installed on the other side of the print head 50 in FIG. 6.

Figure 7:
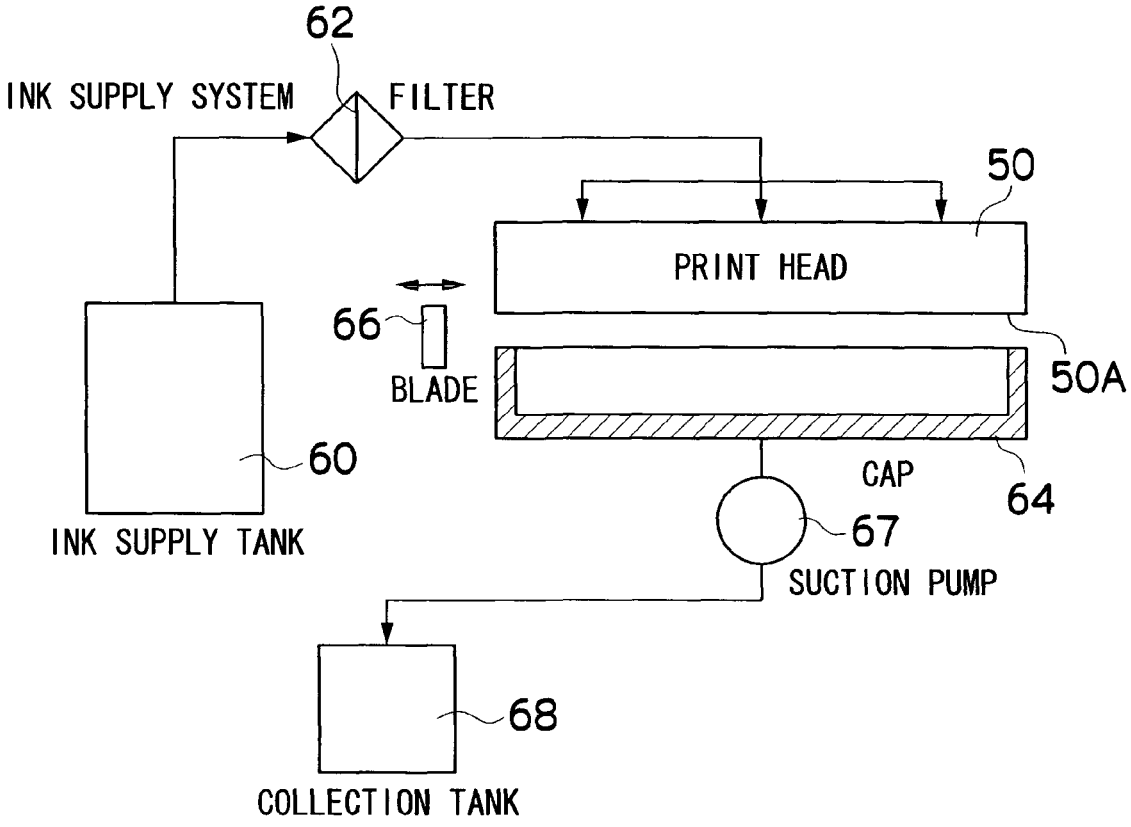
FIG. 7 is a conceptual diagram showing the composition of an ink supply system in the inkjet recording apparatus according to the present embodiment.

FIG. 7 is a schematic drawing showing the configuration of the ink supply system in the inkjet recording apparatus 10.

The ink supply tank 60 is a base tank that supplies ink, and is set in the ink storing and loading unit 14 described with reference to FIG. 1. The aspects of the ink supply tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended use, the cartridge type is suitable. In this case, it is preferable to represent the ink type information with a bar code or the like on the cartridge, and to perform ejection control in accordance with the ink type.

A filter 62 for removing foreign matters and bubbles is disposed between the ink supply tank 60 and the print head 50 as shown in FIG. 7. The filter mesh size in the filter 62 is preferably equivalent to or less than the diameter of the nozzle, and is commonly about 20 μm.

Although not shown in FIG. 7, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 also comprises a cap 64 as a device to prevent the nozzles 51 from drying out or to prevent an increase in the ink viscosity in the vicinity of the nozzles 51, and a cleaning blade 66 as a device to clean the nozzle face.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF and/or when in a print standby state, the cap 64 is raised to a predetermined elevated position so as to come into close contact with the print head 50, and the nozzle face is thereby covered with the cap 64.

During printing and/or standby, if the use frequency of a particular nozzle 51 is low, and if it continues in a state of not ejecting ink for a prescribed time period or more, then the solvent of the ink in the vicinity of the nozzle evaporates and the viscosity of the ink increases. In a situation of this kind, it will become impossible to eject ink from the nozzle 51, even if the actuator 58 is operated.

Therefore, before a situation of this kind develops (namely, while the ink is within a range of viscosity which allows it to be ejected by operation of the actuator 58), the actuator 58 is operated, and a preliminary ejection ("purge", "blank ejection", "liquid ejection" or "dummy ejection") is carried out in the direction of the cap 64 (ink receptacle), in order to expel the degraded ink (i.e., the ink in the vicinity of the nozzle which has increased viscosity).

Furthermore, if air bubbles enter into the ink inside the print head 50 (inside the pressure chamber 52), then even if the actuator 58 is operated, it will not be possible to eject ink from the nozzle. In a case of this kind, the cap 64 is placed on the print head 50, the ink (ink containing air bubbles) inside the pressure chamber 52 is removed by suction, by means of a suction pump 67, and then the ink removed by the suction is supplied to a recovery tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, desirably, the preliminary ejection is carried out while the increase in the viscosity of the ink is still minor.

The cleaning blade 66 is composed of rubber or another elastic member, and can slide on the ink ejection surface 50A (surface of the nozzle plate) of the print head 50 by means of a blade movement mechanism (wiper) (not shown). When ink droplets or foreign matter has adhered to the nozzle plate, the surface of the nozzle plate is wiped and cleaned by sliding the cleaning blade 66 on the nozzle plate. After the ink ejection surface 50A is cleaned by the blade mechanism, the preliminary ejection is performed so as to prevent foreign substance being mixed into the nozzles.

Figure 8:
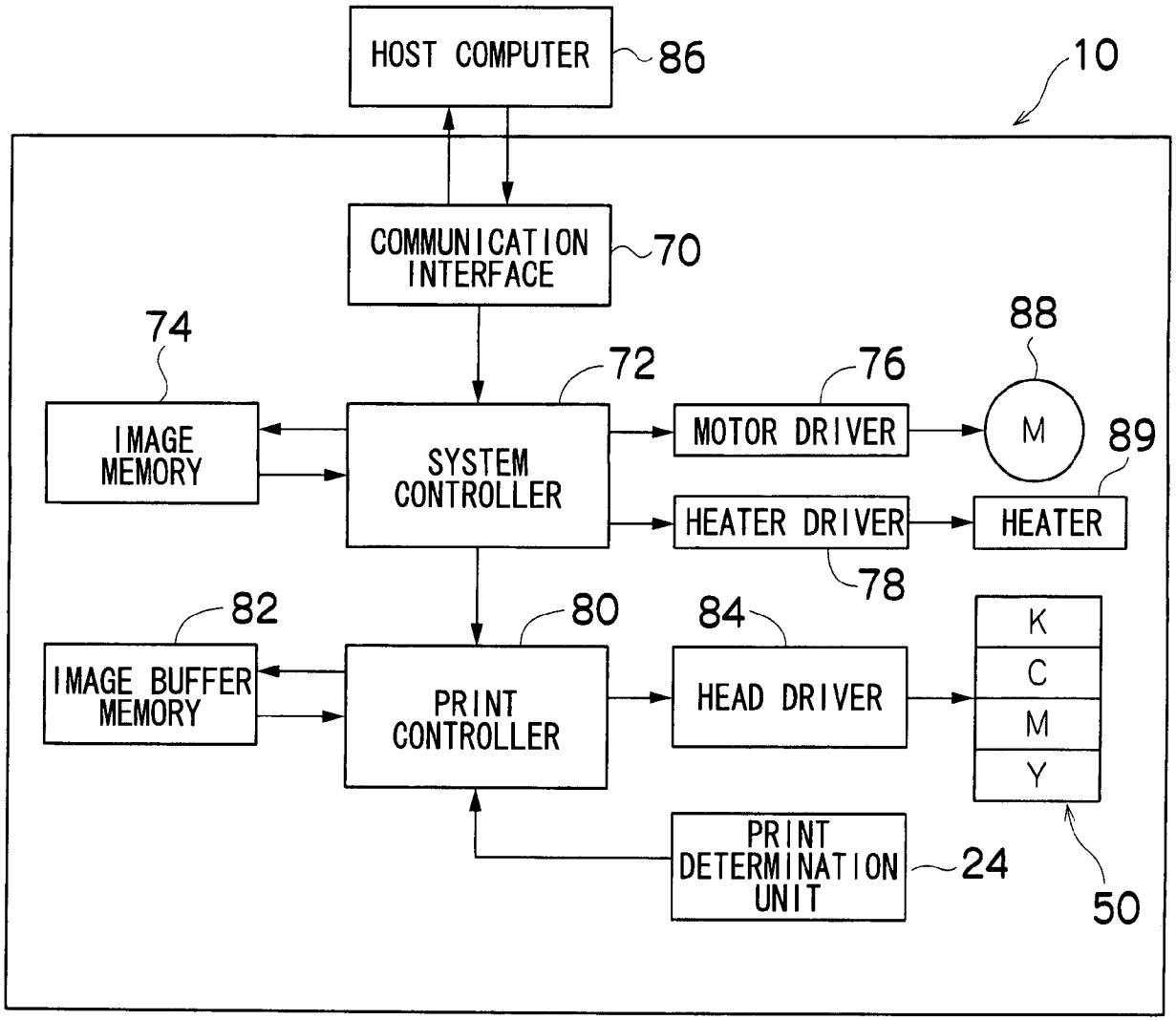
FIG. 8 is a block diagram of the principal components showing the system configuration of the inkjet recording apparatus.

FIG. 8 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74. The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is a control unit for controlling the various sections, such as the communications interface 70, the memory 74, the motor driver 76, the heater driver 78, and the like. The system controller 72 includes a central processing unit (CPU) and peripheral circuits thereof, and the like, and in addition to controlling communications with the host computer 86 and controlling reading and writing from and to the memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. By this means, desired dot size and desired dot positions can be achieved.

The print controller 80 is provided with the image buffer memory 82; and image data, parameters, and other data are temporarily stored in the image buffer memory 82 when image data is processed in the print controller 80. The aspect shown in FIG. 8 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 drives the actuators of the print heads of the respective colors 12K, 12C, 12M and 12Y on the basis of print data supplied by the print controller 80. The head driver 84 can include a feedback control system for maintaining constant drive conditions for the print heads.

Various control programs are stored in a program storage section (not shown), and a control program is read out and executed in accordance with commands from the system controller 72. The program storage section 90 may use a semiconductor memory, such as a ROM, EEPROM, or a magnetic disk, or the like. An external interface may be provided, and a memory card or PC card may also be used. Naturally, a plurality of these storage media may also be provided. The program storage section may also be used as a storage device for storing operational parameters and others (not shown).

The print determination unit 24 is a block that includes the line sensor as described above with reference to FIG. 1, reads the image printed on the recording paper 16, determines the print conditions (presence of the ejection, variation in the dot formation, and the like) by performing required signal processing, or the like, and provides the determination results of the print conditions to the print controller 80.

According to requirements, the print controller 80 makes various corrections with respect to the print head 50 on the basis of information obtained from the print determination unit 24.

In the example shown in FIG. 1, the print determination unit 24 is provided on the print surface side, the print surface is irradiated with a light source (not shown), such as a cold cathode fluorescent tube disposed in the vicinity of the line sensor, and the reflected light is read in by the line sensor. However, in implementing the present invention, another composition may be adopted.

Description of Nozzle Arrangement

Next, the nozzle arrangement of the print head 50 according to the present embodiment is described.

As shown in FIGS. 3 and 5, each of the nozzle rows, in which a plurality of nozzles are arranged in the print head 50 in a direction oblique to the main scanning direction, has the same composition, and nozzle rows 512 and 514 are described below as representative examples of the nozzle rows.

Figure 9:
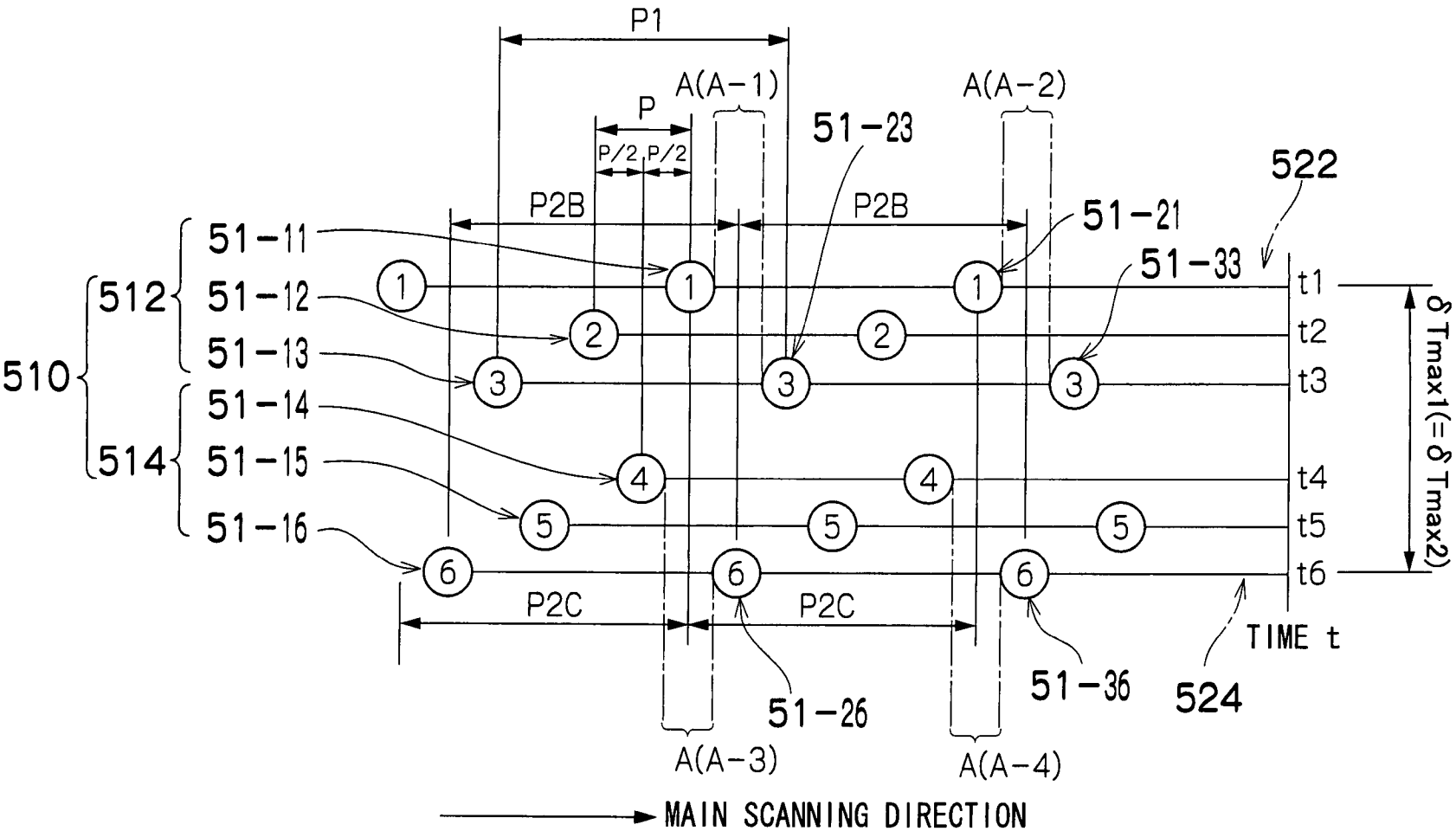
FIG. 9 is a diagram showing the relationship between the nozzle arrangement and the droplet ejection timing in a print head according to an embodiment of the present invention.

FIG. 9 is a diagram showing the nozzle arrangement and droplet ejection timing in the print head 50 according to the present embodiment.

In the print head 500 according to the related art, each of the nozzle rows comprises six nozzles arranged in an oblique column direction forming a uniform non-perpendicular angle θ' with respect to the main scanning direction. In contrast, in the print head 50 according to the present embodiment shown in FIG. 9, each of the nozzle rows 510 is split into two nozzle rows (nozzle row 512 and nozzle row 514), each nozzle row including the three nozzles. The positions of the nozzle row 512 and the nozzle row 514 are staggered in the main scanning direction by ½ of the nozzle pitch P in the main scanning direction.

More specifically, in the print head 50, a plurality of nozzle rows having a prescribed inclination angle θ with respect to the main scanning direction are aligned in the main scanning direction to form a nozzle group (corresponding to an ejection aperture group), which is split into two parts in the sub-scanning direction. The two split nozzle groups 522 and 524 in the sub-scanning direction are shifted in phase with respect to each other in the main scanning direction by ½ of the nozzle pitch P in the main scanning direction.

In other words, the nozzles 51, which are arranged in a matrix fashion in the row direction extending in the main scanning direction and in the column direction forming a prescribed angle θ with respect to the main scanning direction, are divided into n nozzle groups in the sub-scanning direction, and the nozzle groups are shifted in phase from each other in the main scanning direction.

Therefore, when the nozzle row 512 and the nozzle row 514 are projected to align in the main scanning direction, the nozzles 51-11 to 51-16, forming the nozzle rows 512 and 514, are arranged at regular intervals in the main scanning direction. Moreover, the nozzle 51-14 is positioned between the nozzle 51-11 and nozzle 51-12, and the nozzle 51-15 is positioned between the nozzle 51-12 and nozzle 51-13. Furthermore, the nozzle 51-16 is positioned on the opposite side of the nozzle 51-15, at a distance of P/2 from the nozzle 51-13 in the main scanning direction.

The nozzle-to-nozzle pitch P in the main scanning direction (the pitch between the nozzles in the projected nozzle row obtained by projecting the nozzles so that the nozzles are aligned in the main scanning direction) is determined in such a manner that the ink droplets ejected at timings t1 to t3 do not interfere with each other on the recording paper 16.

Figure 23:
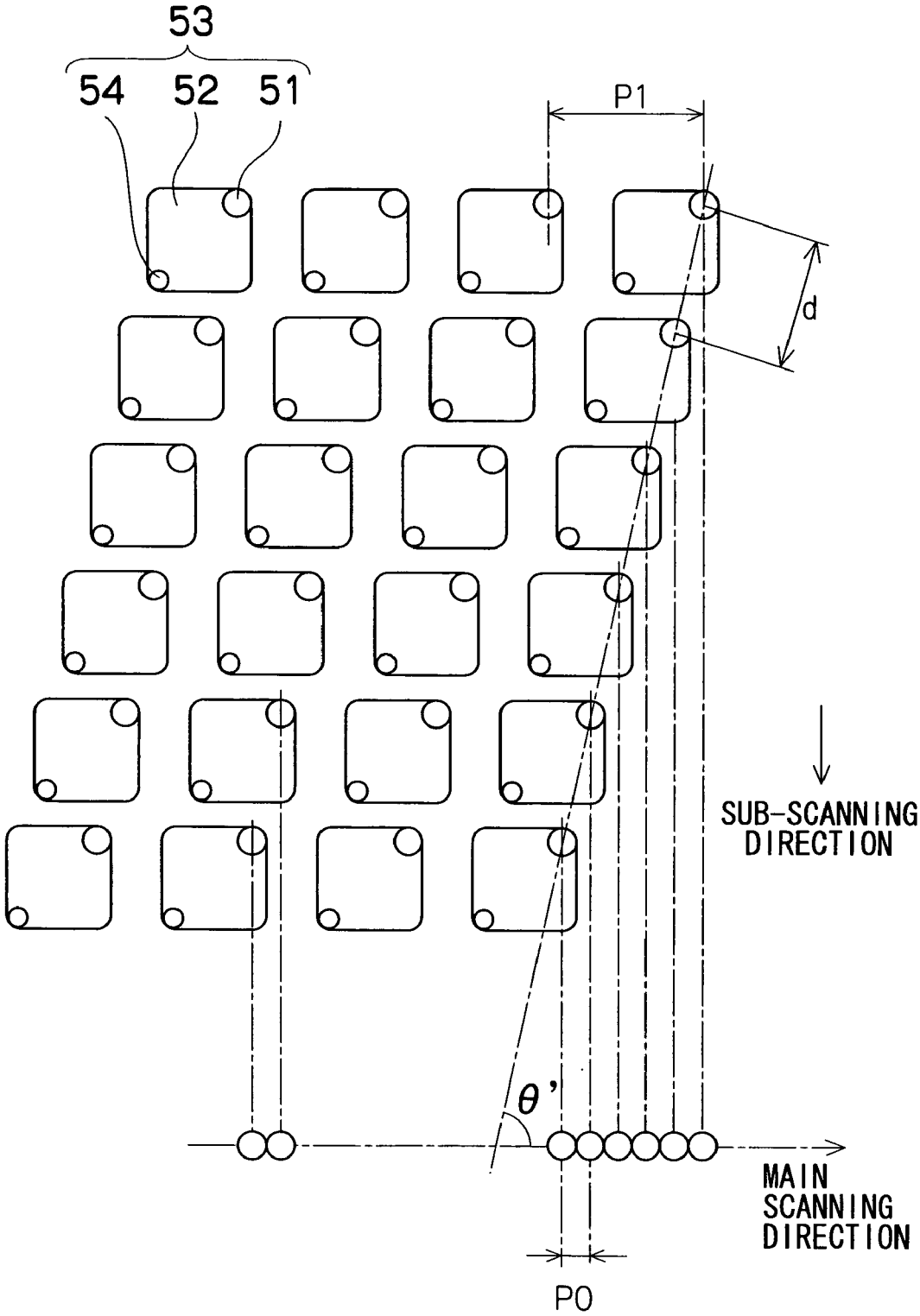
FIG.23 RELATED ART
FIG. 23 is an enlarged view showing a nozzle arrangement in the print head shown in FIGS. 22A and 22B.

More specifically, the distance, between two dots that are deposited on every other dot position in a consecutive fashion in the main scanning direction, is set to a distance whereby the two dots do not overlap with each other. Thus, the nozzle pitch P in the main scanning direction is set to a value that is greater than the nozzle-to-nozzle pitch P0 shown in the related art (FIG. 23) (in other words, P>P0).

In FIG. 9, the numbers shown inside the circles representing the nozzles 51 indicate the droplet ejection timing. At timing t1, droplets are ejected from nozzle 51-11, nozzle 51-21, nozzle 51-31 (not shown in FIG. 9), and so on. Next, at timing t2, droplets are ejected from nozzles 51-12, and so on. Furthermore, at timing t3 to timing t6, droplets are ejected from nozzles 51-13, . . . , nozzle 51-16, nozzle 51-26, nozzle 51-36, and so on. By means of one cycle of droplet ejection at timings t1-t6, it is possible to form a row of dots in one line in the main scanning direction.

In the droplet ejections performed at timings t1 to t3, the ink droplets ejected at the respective timings do not make contact with the other ink droplets on the recording paper 16, and do form dots by themselves.

On the other hand, at timings t4-t6, when an ejected ink droplet lands on the paper, other ink droplets already have been ejected at the adjacent landing positions on both sides thereof in the main scanning direction and have landed on the recording paper. Hence, the ink droplets ejected at timings t4-t6 make contact with the ink droplets on both sides that have been previously deposited onto the recording paper 16.

More specifically, the ink droplet ejected at timing t4 is deposited between the ink droplets ejected at timing t1 and timing t2. Similarly, the ink droplet ejected at timing t5 is deposited between the ink droplets ejected at timing t2 and timing t3, and the ink droplet ejected at timing t6 is deposited between the ink droplets ejected at timing t1 and timing t3.

Since the ink droplets ejected at timings t4 to t6 are attracted to the previously deposited ink droplets on both sides, the ink droplets ejected at timings t4 to t6 are not drawn to one side, and the dots formed by the ink droplets ejected at timings t4 to t6 become symmetrical, thus making it possible to reduce striped unevenness caused by unidirectional aggregation.

Figure 26A:
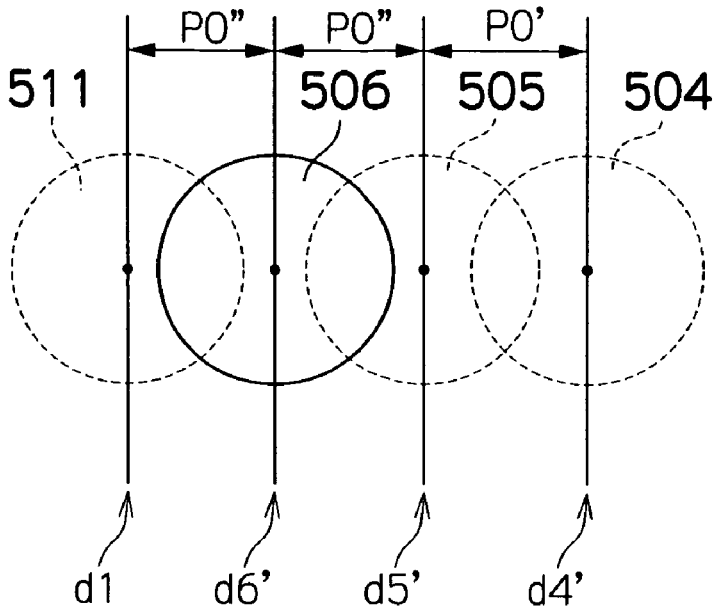
FIG.26A RELATED ART
FIGS. 26A and 26B are diagrams for describing landing interference at return positions in a print head according to the related art.
Figure 26B:
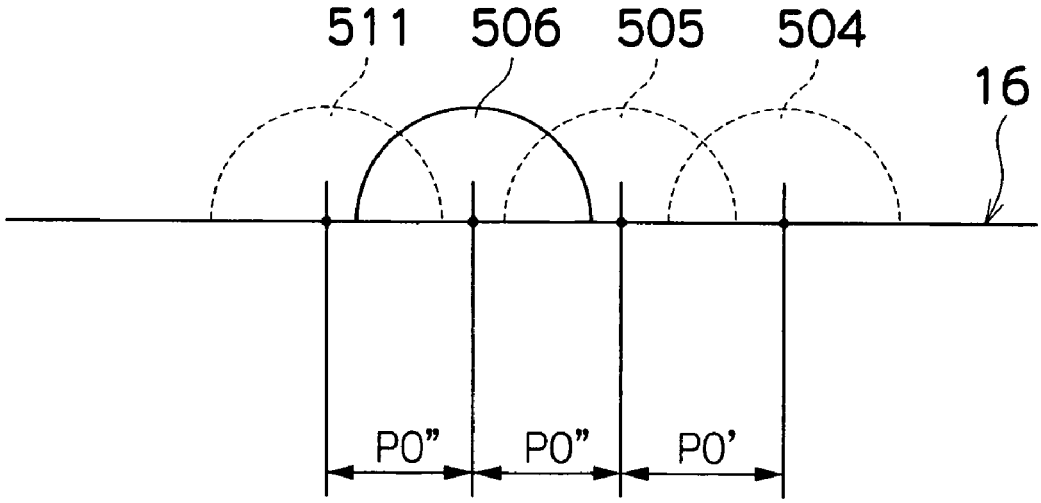
FIG.26B RELATED ART

In the related art shown in FIGS. 26A and 26B, the ink droplet 501 lands independently, and the ink droplet 506 is deposited between the ink droplet 511 and the ink droplet 505, and hence is affected by aggregation toward both sides. The other ink droplets are affected by aggregation in one direction due to a previously deposited ink droplet. Therefore, striped unevenness occurs in the vicinity of the ink droplet 506 due to difference in the aggregation conditions.

In the present specification, the return position A is defined as, in the print head 50 having the nozzle arrangement shown in FIG. 9, the boundary between the nozzle rows arranged adjacently in the main scanning direction of the nozzle rows (512, 514, etc.) in each of the nozzle groups 522, 524, where the pitch between nozzles in the sub-scanning direction is larger than that between other nozzles.

More specifically, in the nozzle arrangement shown in FIG. 9, the position (corresponding to the return position A-1) between nozzle 51-11 and nozzle 51-23 and the position (corresponding to the return position A-3) between nozzle 51-14 and nozzle 51-26, and so on, form the return positions A.

The difference in landing time between the respective ink droplets at these return positions A (for example, the difference between the landing time of the ink droplet ejected from nozzle 51-11 and the landing time of the ink droplet ejected from nozzle 51-23) is different from the difference in landing time between the droplets ejected from the nozzles (for example, nozzles 51-11 and 51-12, nozzles 51-12 and 51-13, etc.) arranged adjacently in the same nozzle row. Thus, the amount of the previously deposited ink droplet that is remaining on the recording paper 16 is also different. Consequently, there is a difference in aggregation conditions between the regions corresponding to the return positions A and the regions other than the return positions A. Hence, striped unevenness due to the aggregation occurs at the regions corresponding to the return positions A.

In FIG. 9, the interval P2B is 0.94 mm between the return positions in the nozzle group 522 (the pitch between return positions), such as the interval between the return position A-1 and the return position A-2. The spatial frequency of the striped unevenness caused by aggregation at the regions corresponding to the return positions corresponds to 1.061 lp/mm. According to the visibility curve 600 shown in FIG. 27, this falls within the spatial frequency range in which unevenness is comparatively apt to be perceived.

The interval P2C is also 0.94 mm between return positions in the nozzle group 524, such as the interval between return position A-3 and return position A-4, and the spatial frequency is similar to that concerning the return position in nozzle row 512. As shown in FIG. 9, since the return position A-1 and the return position A-4 are close to each other, the perceived spatial frequency on the recorded image can be taken to be 1.061 lp/mm or so.

Figure 10:
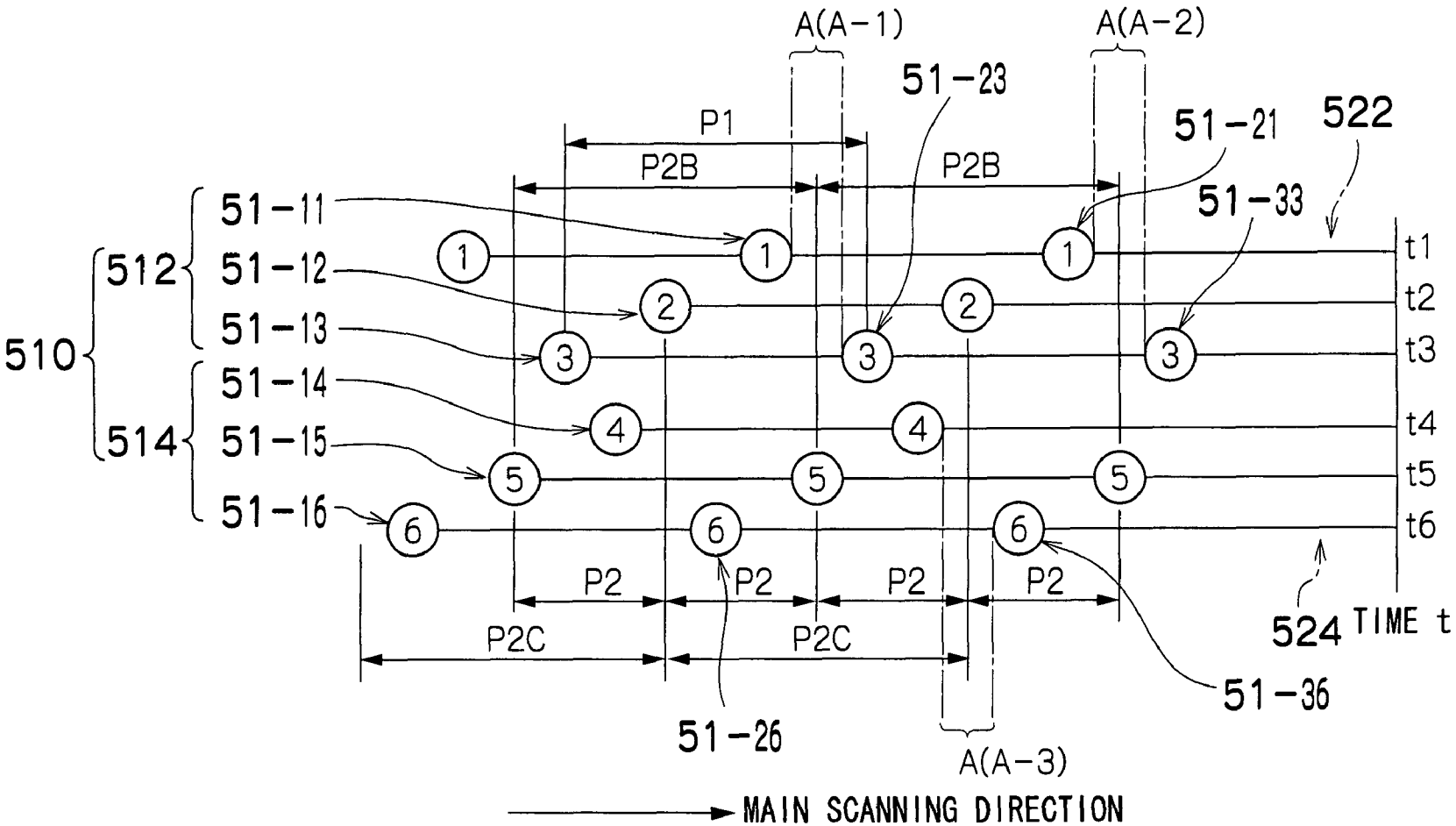
FIG. 10 is a diagram showing the relationship between another mode of the nozzle arrangement shown in FIG. 3 and the droplet ejection timing.

In contrast, in the nozzle arrangement shown in FIG. 10, the nozzles are shifted in phase in the main scanning direction by one half of the pitch between the return positions, in such a manner that the intervals P2 between the return position A-1 in nozzle group 522 and the return position A-3 in nozzle group 524 are uniform.

Figure 27:
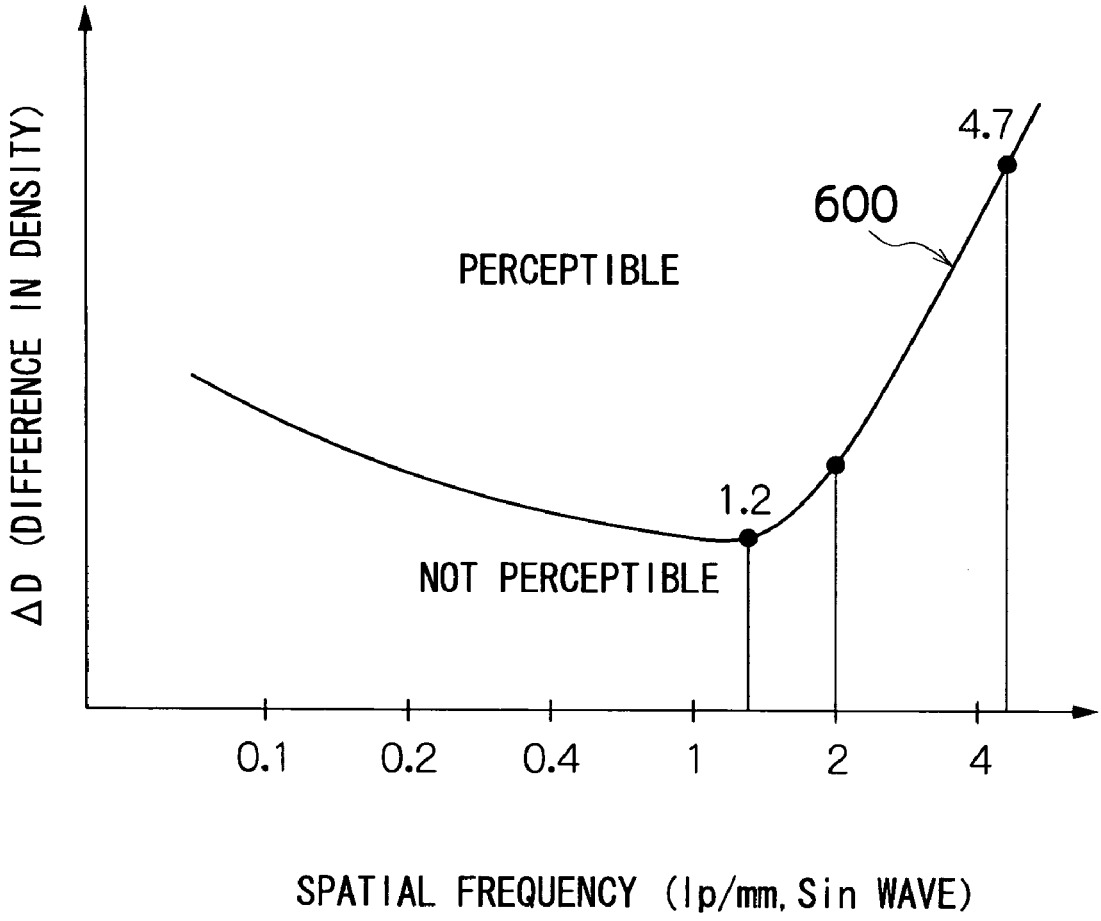
FIG.27 RELATED ART
FIG. 27 is a graph showing a visibility curve.

Thus, the substantial cycle of the return positions A satisfies P2=0.47 mm, and the spatial frequency of the regions corresponding to the return positions having this cycle is 2.13 lp/mm. As will be appreciated from the visibility curve 600 shown in FIG. 27, compared to the nozzle arrangement shown in FIG. 9, it is possible to arrange the nozzles by shifting them in a certain direction whereby visibility of unevenness of density on the recorded medium is reduced.

Desirably, the pitch P2 between the return positions is set so that the cycle of the return positions is not less than 2.0 lp/mm, and more desirably, not less than 3.0 lp/mm, since this allows considerable reduction in the visibility of the striped unevenness.

In the print head having the nozzle arrangement that the pitches P2 between the return positions are equivalent to each other as shown in FIG. 10, the number of the nozzle groups in the sub-scanning direction is an even number.

Description of the Difference in Landing Time (Landing-time Difference)

In some type of ink and/or some type of recording paper 16, it is also possible to effectively reduce the visibility of uneven density by optimizing the differences between landing times (differences between ejection times) instead of optimizing the pitch P2 between the return positions as shown in FIGS. 9 and 10. More specifically, it is preferable to determine the nozzle arrangement in the print head 50 so that the difference between the landing times of the ink droplets that form adjacent dots is smaller than the maximum difference between the landing times of the ink droplets in the print head 50.

If a dot row including dots aligned consecutively in one line in the main scanning direction is formed by using the print head 50 with the nozzle arrangement shown in FIG. 9, then a combination of nozzles at which the difference in landing times between two nozzles that eject ink droplets to form mutually adjacent dots is a maximum value, δTmax1, includes, for instance, a combination of a nozzle that performs droplet ejection at timing t1 (such as nozzle 51-11) and a nozzle that performs droplet ejection at timing t6 (such as nozzle 51-26).

Of the combinations of the nozzles ejecting droplets that form the adjacent dots, the combination of the nozzles that the difference in landing time is the maximum value δTmax1 is the combination of the nozzles in the nozzle arrangement shown in FIG. 9 that the difference in landing time is the maximum value δTmax2. In other words, the nozzle arrangement shown in FIG. 9 satisfies the relationship: δTmax1=δTmax2, and droplets are ejected to form dots that are mutually adjacent in the main scanning direction by using nozzles that have a maximum nozzle-to-nozzle distance in the sub-scanning direction. Accordingly, the difference between the landing times of the droplets is greater than that concerning other dots located adjacently in the main scanning direction, and there is a possibility that the striped unevenness due to the landing-time difference occurs on the recorded image, depending on a kind of the recording paper 16 and/or a kind of the ink.

Figure 11A:
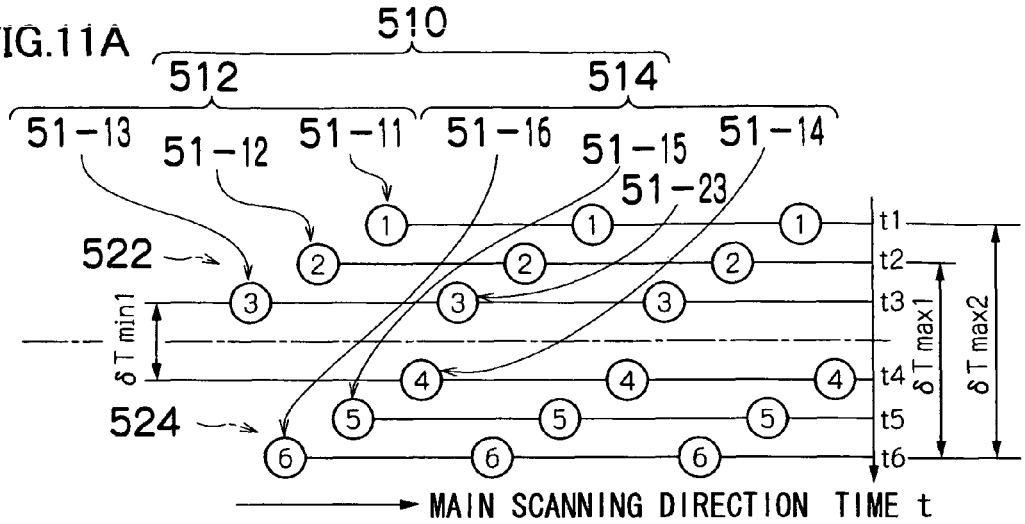
FIGS. 11A to 11C are diagrams showing the relationship between another mode of the nozzle arrangement shown in FIG. 10 and the droplet ejection timing.
Figure 11B:
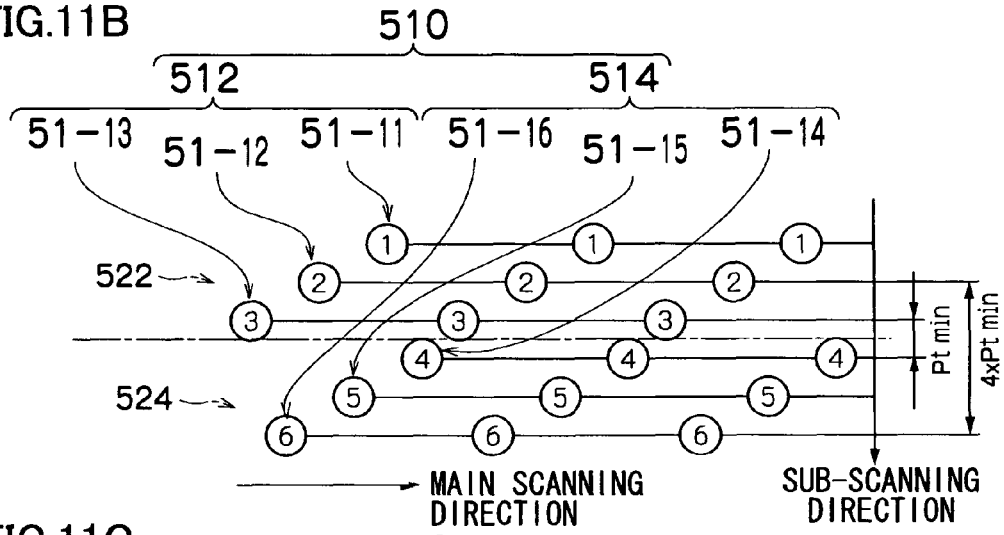

In the nozzle arrangement shown in FIGS. 11A and 11B, the difference in landing times is more optimized with respect to the nozzle arrangement shown in FIG. 9. The nozzle arrangement is determined so that the combination of the nozzles being different from the combination of the nozzles where the landing-time difference is the maximum value δTmax2, is used for the nozzles that eject the ink droplets forming the adjacent dots.

More specifically, in the nozzle arrangement shown in FIGS. 11A and 11B, when a row of dots aligned consecutively in one line in the main scanning direction is formed, the combination of nozzles at which the difference between the landing times of the nozzles of the print head 50 is a maximum value δTmax2, includes, for instance, a combination of a nozzle that performs droplet ejection at timing t1 (for example, nozzle 51-11) and a nozzle that performs droplet ejection at timing t6 (for example, nozzle 51-16), similarly to the nozzle arrangement shown in FIG. 9.

On the other hand, a combination of nozzles where the difference in landing times between two nozzles that eject ink droplets to form mutually adjacent dots is the maximum value δTmax1, includes, for instance, a combination of a nozzle that performs droplet ejection at timing t2 (for example, nozzle 51-12) and a nozzle that performs droplet ejection at timing t6 (for example, nozzle 51-16).

Therefore, if a row of dots aligned consecutively in one line in the main scanning direction is formed by means of the nozzle arrangement shown in FIGS. 11A and 11B, then the relationship between the maximum value δTmax1 of differences in the landing time concerning the nozzles that eject droplets to form mutually adjacent dots (the adjacent-landing-time differences), and the maximum value δTmax2 of the landing-time differences in the print head 50 satisfies δTmax1<δTmax2.

More specifically, since the ink droplets forming the adjacent dots are ejected by using the nozzles other than two nozzles at which the nozzle-to-nozzle distance in the sub-scanning direction is the maximum in the print head 50, then there is no significant variation in the difference between the landing times, compared to other nozzles that eject droplets to form dots that are adjacent in the main scanning direction. Hence, striped unevenness caused by aggregation resulting from an extreme difference between landing times can be avoided.

If a row of dots aligned consecutively in one line in the main scanning direction is formed by using the print head 50 having the nozzle arrangement shown in FIG. 11A, then a combination of nozzles at which the difference between the landing times concerning the nozzles ejecting the ink droplets to form dots that are adjacent in the main scanning direction is a minimum value δTmin1 includes, for instance, a nozzle that performs droplet ejection at timing t3 and a nozzle that performs droplet ejection at timing t4 (such as a combination of nozzle 51-23 and nozzle 51-14).

As shown in FIG. 11B, the distance between these nozzles in the sub-scanning direction is set to a distance equal to the minimum value Ptmin of the nozzle-to-nozzle distance in the sub-scanning direction between the nozzles in the print head 50.

On the other hand, if a row of dots aligned consecutively is formed in one line in the main scanning direction, then the nozzle pitch in the sub-scanning direction between nozzles at which the difference between the landing times of nozzles forming dots that are adjacent in the main scanning direction is a maximum value δTmax1, (for example, nozzle 51-23 and nozzle 51-16) is set to 4×Ptmin. In this case, the relationship between the minimum value δTmin1 of the differences between landing times and the maximum value δTmax1 of the differences between landing times satisfies δTmin1/δTmax1=0.25.

Figure 11C:
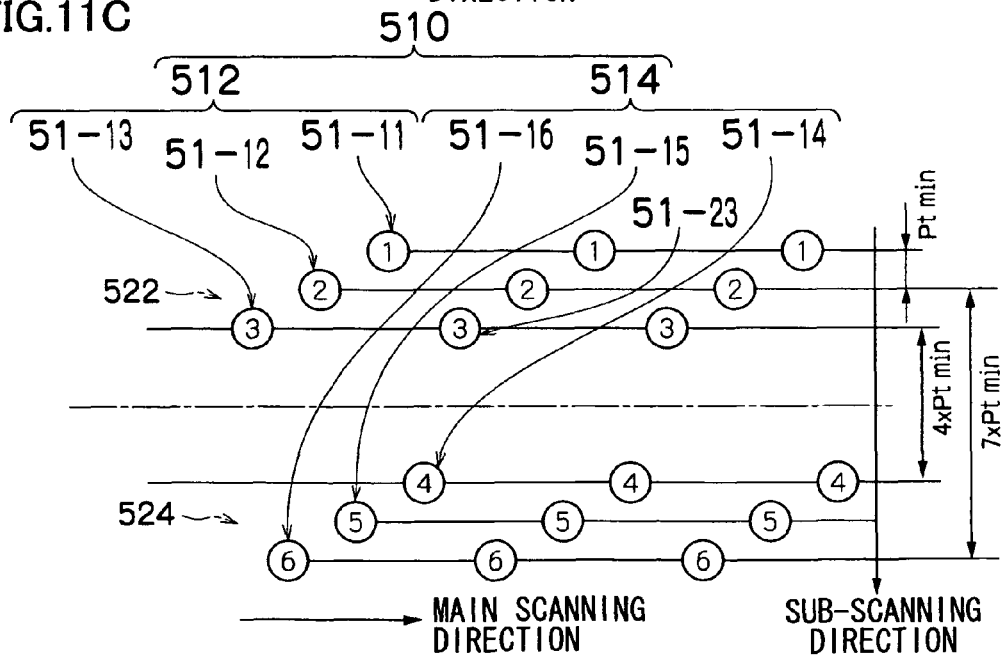

Furthermore, if a row of dots aligned consecutively is formed in one line in the main scanning direction by using a print head 50 with the nozzle arrangement shown in FIG. 11C, a combination of nozzles at which the difference between the landing times of nozzles forming dots that are adjacent in the main scanning direction is a minimum value δTmin1 includes, for instance, a nozzle that performs droplet ejection at timing t3 (for example, nozzle 51-12) and a nozzle that performs droplet ejection at timing t4 (for example, nozzle 51-14).

As shown in FIG. 11C, the nozzle-to-nozzle distance in the sub-scanning direction between these nozzles is set to 4×Ptmin with respect to the minimum value Ptmin of the nozzle-to-nozzle distance in the sub-scanning direction between the nozzles in the print head 50 (for example, the distance in the sub-scanning direction between nozzle 51-11 and nozzle 51-12).

The nozzle pitch in the sub-scanning direction between nozzles at which the difference between the landing times concerning nozzles forming dots that are adjacent in the main scanning direction is a maximum value δTmax1 (for example, nozzle 51-12 and nozzle 51-16), is set to 7×Ptmin. In this case, the relationship between the minimum value δTmin1 of the differences between landing times and the maximum value δTmax1 of the differences between landing times satisfies δTmin1/δTmax1=0.57.

By comparing the striped unevenness caused by aggregation in the nozzle arrangement shown in FIG. 11B to that in the nozzle arrangement shown in FIG. 11C, it can be seen that the result tends to be better in the case of the nozzle arrangement shown in FIG. 11C in which the ratio of the differences between landing times of the ink droplets forming adjacent dots (namely, the ratio δTmin1/δTmax1) is close to 1 (in other words, where there is little variation in the ratio of the differences between landing times).

In particular, it has been deduced from experimentation that the tendency of the visibility of striped unevenness produced by aggregation changes on the boundary condition where the ratio of the differences between landing times δTmin1/δTmax1 is 0.5. Hence, according to the experimentation, the tendency of the visibility of striped unevenness is bounded by the ratio of δTmin1/δTmax1 is 0.5. Accordingly, an embodiment satisfying the following relationship is preferable: δTmin1/δTmax1≧0.5.

Thus, the variation in the landing-time differences between the ink droplets that are deposited at adjacent positions can be reduced, and the visibility of the striped unevenness due to aggregation can be reduced, by optimizing the distances in the sub-scanning direction between the nozzle groups.

In the present embodiment, the print head comprising a nozzle group where a plurality of the nozzle rows, each of which has the three nozzles, are arranged in the main scanning direction is explained as an example. However, the number of the nozzles in each nozzle row is not limited to three, and the two or more nozzles may be provided in each nozzle row. Moreover, in the present embodiment, the plurality of the nozzle groups having the same nozzle arrangement are staggered in the main scanning direction, and are arranged in the sub-scanning direction. However, a plurality of the nozzle groups having the different nozzle arrangements may be arranged in the sub-scanning direction. The different arrangements include a mode where the numbers of the nozzles in the nozzle rows in the nozzle groups are different, and a mode where the nozzle-to-nozzle pitches in the sub-scanning direction in the nozzle groups are different.

Other Embodiments

Next, other embodiments of the present invention are described below.

Figure 12:
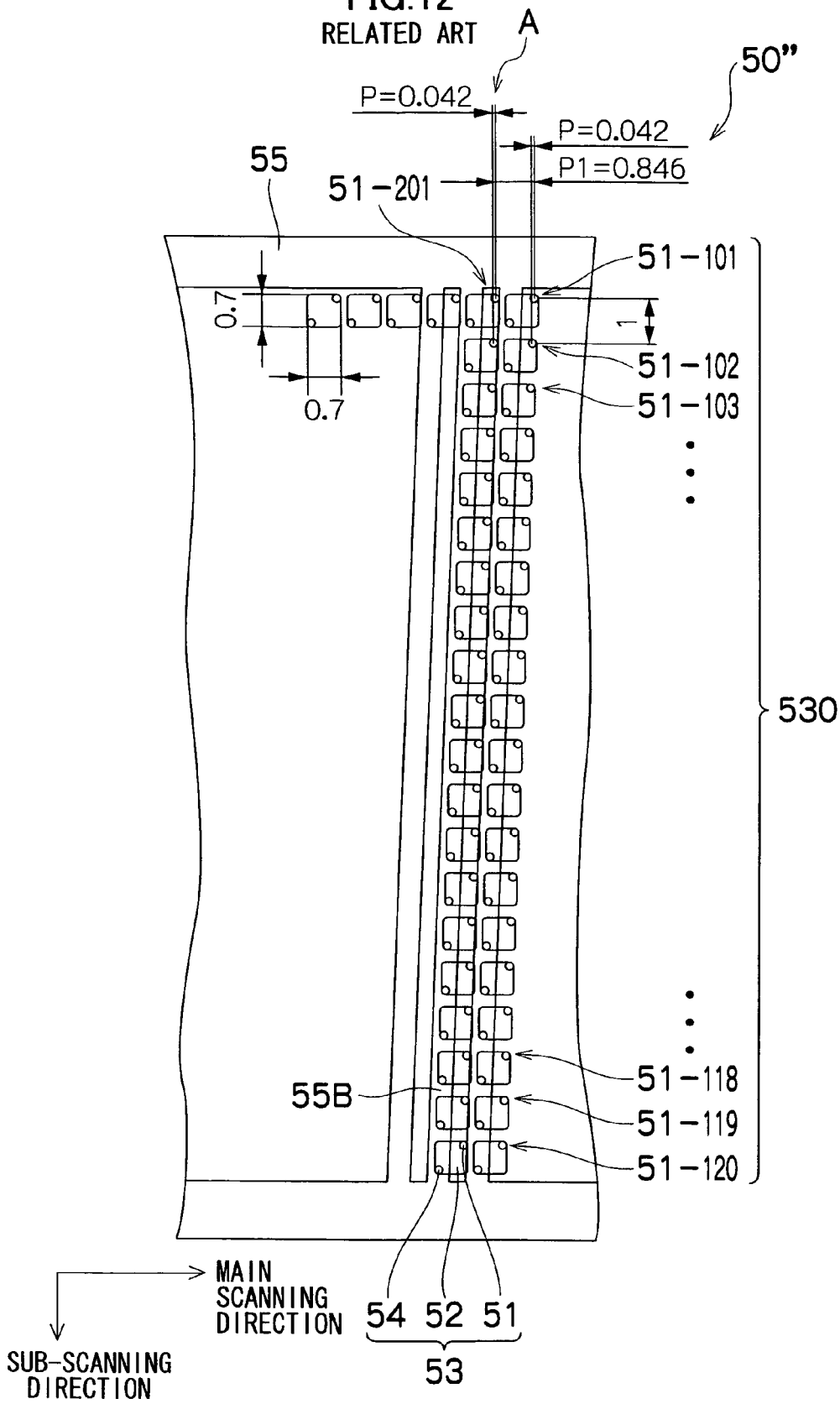
FIG.12 RELATED ART
FIG. 12 is a planar perspective view showing the nozzle arrangement of a print head according to the related art.

FIG. 12 shows a nozzle arrangement in a print head 50" according to the related art.

Figure 13:
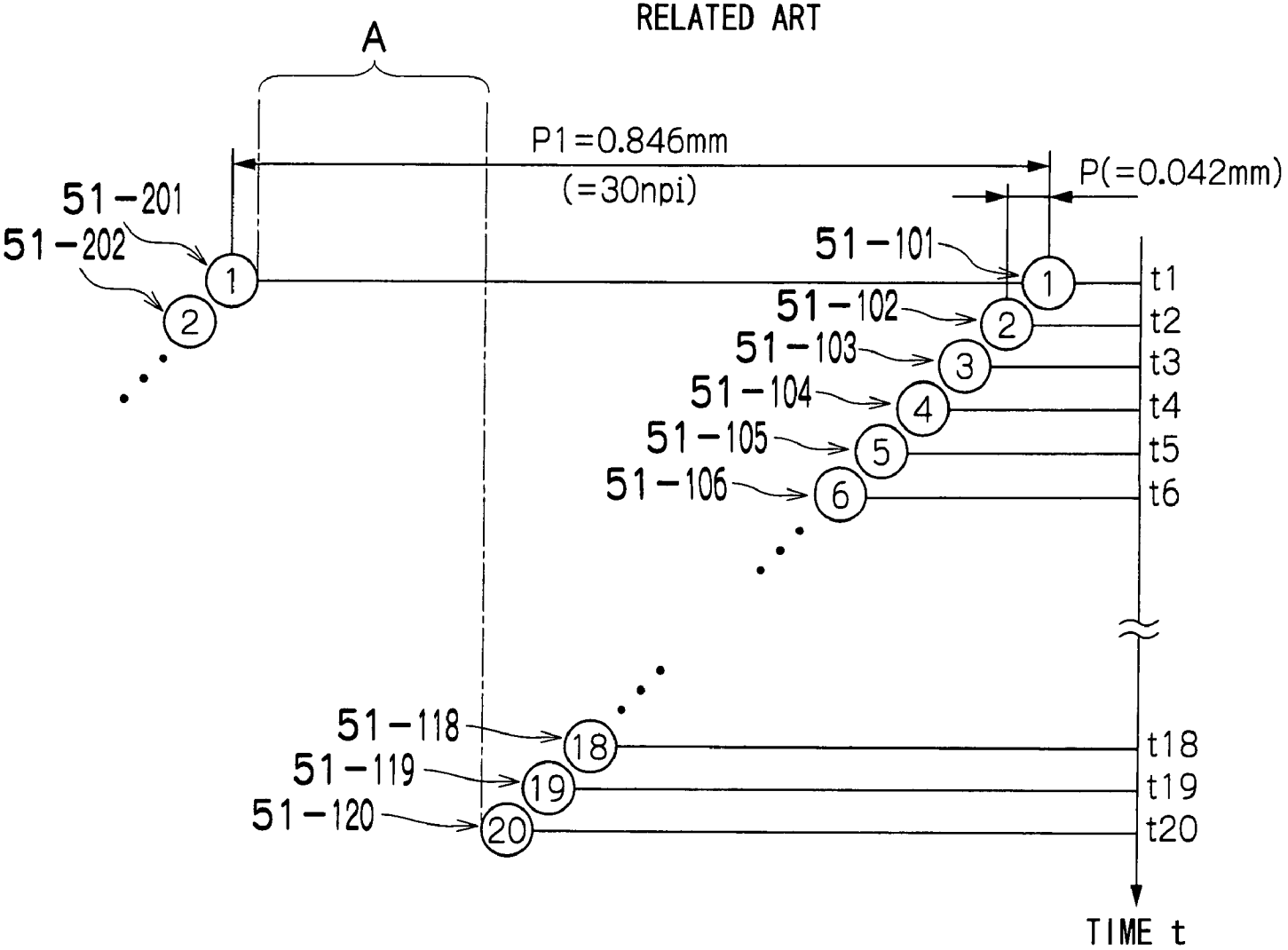
FIG.13 RELATED ART
FIG. 13 is a diagram for explaining the relationship between the nozzle arrangement and the droplet ejection timing in a print head according to the related art.
Figure 24:
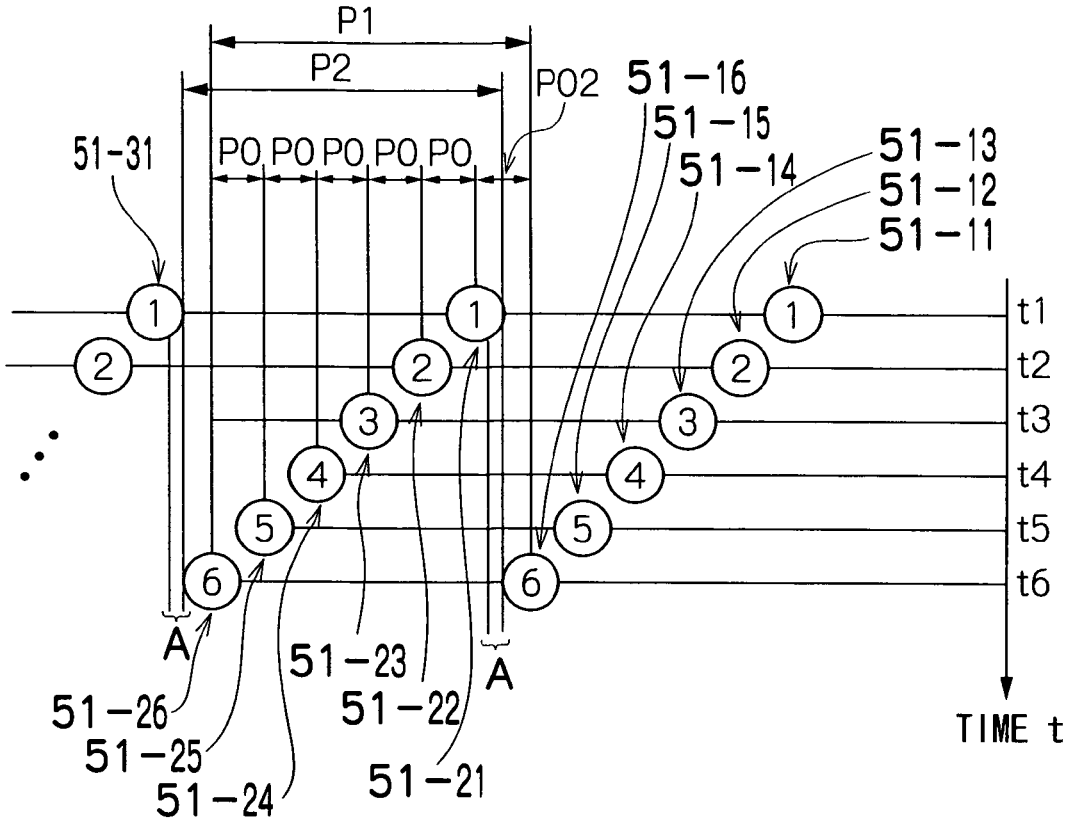
FIG.24 RELATED ART
FIG. 24 is a diagram showing the relationship between the nozzle arrangement and the droplet ejection timing in a print head according to the related art.
Figure 25A:
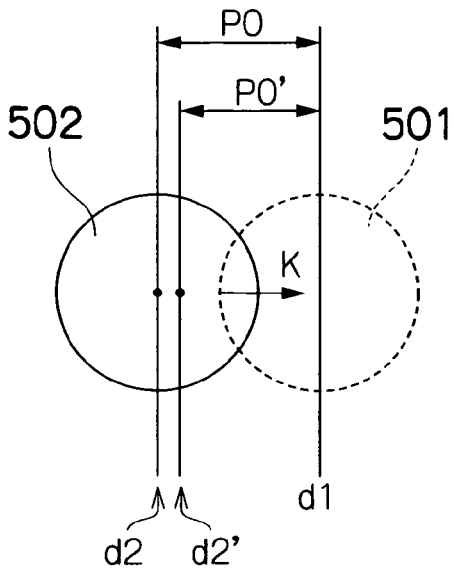
FIG.25A RELATED ART
FIGS. 25A and 25B are diagrams for describing landing interference in a print head according to the related art.
Figure 25B:
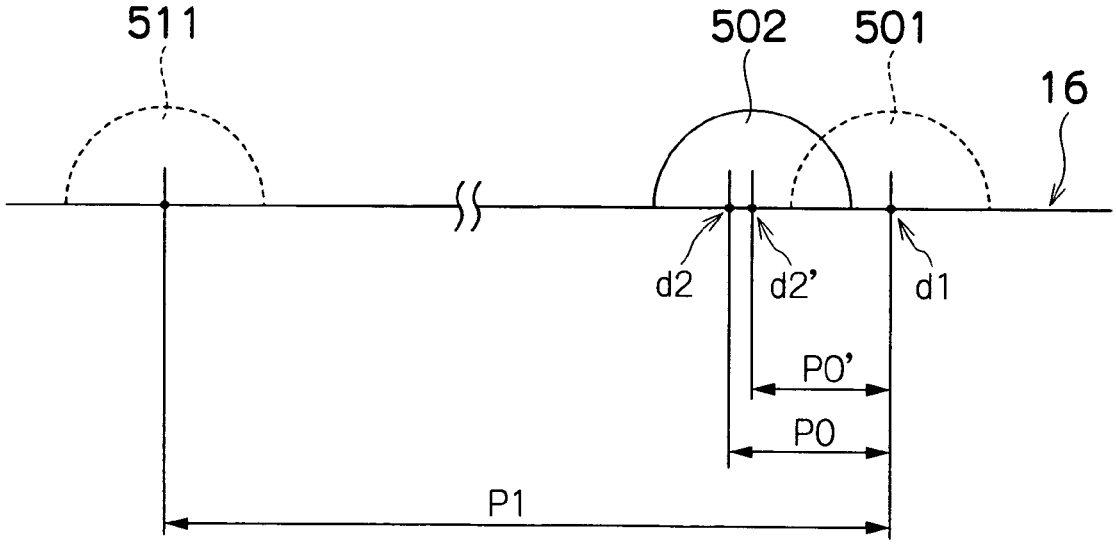
FIG.25B RELATED ART

The print head 50" comprises a nozzle row 530 having 20 nozzles arranged in an oblique column direction with a uniform angle θ non-perpendicular to the main scanning direction. FIG. 13 shows the relationship between the nozzle arrangement in FIG. 12 and the droplet ejection timing. In FIG. 13, items that are the same as or similar to those in FIG. 24 are denoted with the same reference numerals, and description thereof is omitted here.

As shown in FIG. 12, in the print head 50", a plurality of nozzle rows are arranged in the main scanning direction in the order of nozzle 51-101, nozzle 51-102, nozzle 51-103, . . . , nozzle 51-118, nozzle 51-119 and nozzle 51-120, and each nozzle row comprises 20 nozzles aligned in one row in a direction oblique to the main scanning direction.

Furthermore, the pitch P1 between nozzles that are adjacent in the main scanning direction (for example, the interval between nozzle 51-101 and nozzle 51-201) is 0.846 mm, and the nozzle pitch P in the main scanning direction (for example, the interval between nozzle 51-101 and nozzle 51-102) is 0.042 mm.

Apart from this, the specifications of the print head 50" conform to standard matrix head specifications as described as the related art.

In the print head 50" having the nozzle arrangement shown in FIG. 12, droplets are ejected from nozzle 51-101, nozzle 51-201, and so on, at timing t1, and droplets are ejected from nozzle 51-102, nozzle 51-202, and so on, at timing t2, as shown in FIG. 13. Similarly, at timings t3 to t20, droplets are ejected from the corresponding nozzles. More specifically, at timing t3, droplets are ejected from nozzle 51-103 and so on, at timing t4, droplets are ejected from nozzle 51-104 and so on, at timing t5, droplets are ejected from nozzle 51-105 and so on, at timing t6, droplets are ejected from nozzle 51-106 and so on, . . . , and similarly, at timing t18, droplets are ejected from nozzle 51-118 and so on, at timing t19 droplets are ejected from nozzle 51-119 and so on, and at timing t20, droplets are ejected from nozzle 51-120 and so on. When droplets have been ejected from nozzle 51-120 and so on at timing t20, then the sequence returns to timing t1 and the aforementioned droplet ejection operation is repeated.

When one cycle of droplet ejection has been performed as described above, a row of dots arranged consecutively in one line in the main scanning direction is formed on the recording paper 16.

In the case of the nozzle arrangement shown in FIG. 12, as described as the related art, striped unevenness may occur in the sub-scanning direction at a return position A (for example, the section between nozzle 51-120 and nozzle 51-201) due to landing interference.

This is due to the line-shaped unevenness, such as non-uniform density, induced by the peculiarity of the landing interference occurring at the regions corresponding to the return position A, and the fact that the nozzle pitch P1 between the nozzles that are adjacent in the main scanning direction has a spatial frequency that is readily perceptible as a linear unevenness.

Figure 14:
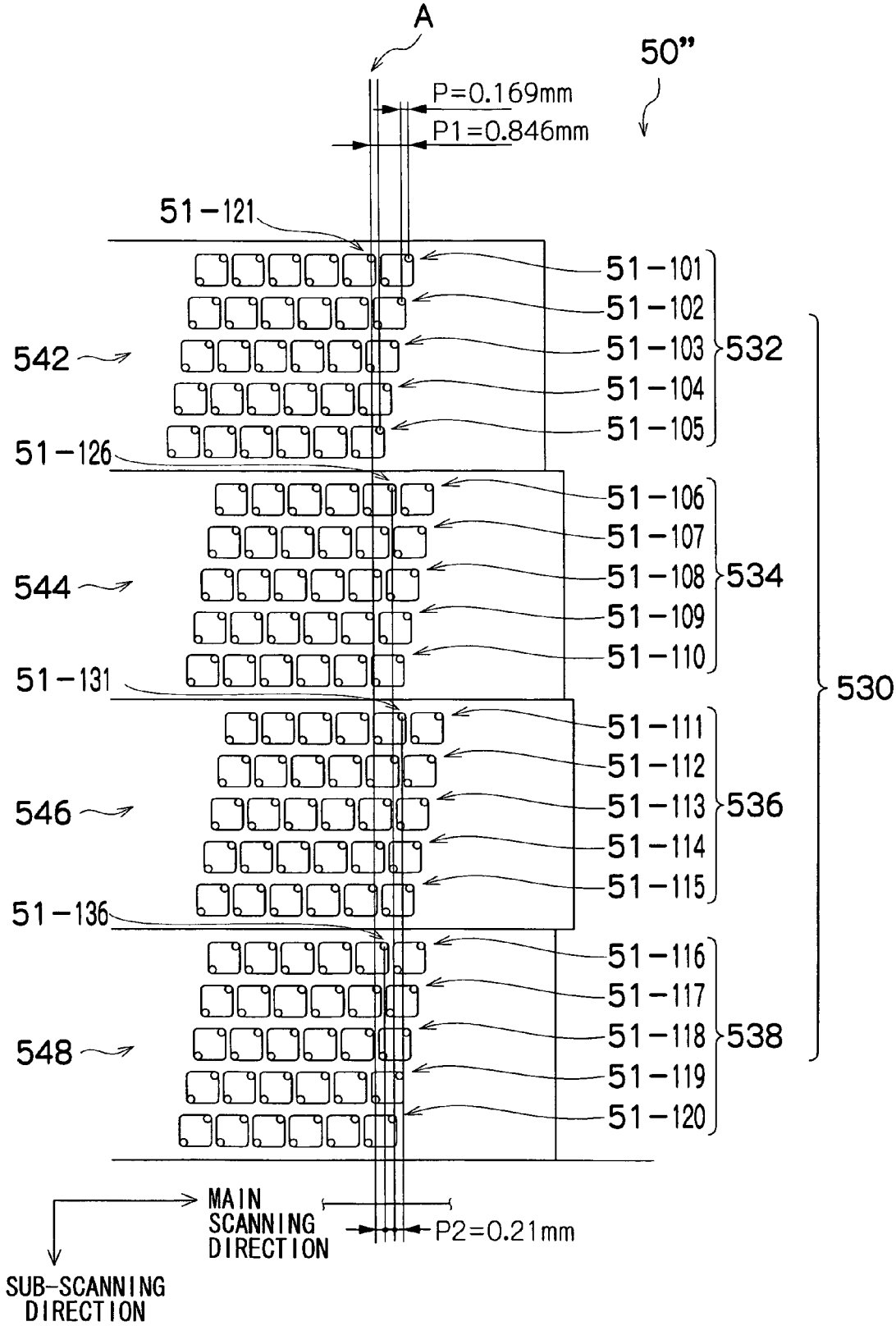
FIG. 14 is a planar perspective view of an application of the nozzle arrangement shown in FIG. 3.

FIG. 14 shows a print head 500" having a nozzle arrangement for resolving the problems of the related art described with reference to FIGS. 12 and 13.

As shown in FIG. 14, the nozzles of the print head 500" that are arranged in a matrix fashion are divided into four blocks in the sub-scanning direction, and these divided blocks (nozzle groups) 542, 544, 546, and 548 are staggered in phase in the main scanning direction.

This is equivalent to dividing the print head 50", shown in FIG. 12, into four blocks (nozzle groups 542, 544, 546, and 548) in the sub-scanning direction and arranging the nozzle groups with the staggered phases in the main scanning direction.

If the print head 50", shown in FIG. 12, is divided into four groups in the sub-scanning direction and these nozzle groups are arranged in a staggered phase in the main scanning direction in this way, then the return positions A are formed at four positions between nozzle 51-105 and nozzle 51-121, between nozzle 51-110 and nozzle 51-126, between nozzle 51-115 and nozzle 51-131, and between nozzle 51-120 and nozzle 51-136. Thus, the spatial frequency concerning each of the return positions A can be made four times that of the nozzle arrangement shown in FIG. 12 (namely, a high frequency).

Therefore, it is possible to improve the peculiarity at the regions corresponding to the return positions A, and hence the visibility of striped unevenness at the regions corresponding to the return positions A can be reduced.

Furthermore, in the nozzle arrangement shown in FIG. 14, similar to the arrangement shown in FIG. 10, the respective nozzle groups 542, 544, 546, and 548 are staggered in position in the main scanning direction, in such a manner that the pitches between return positions P2 are uniform.

More specifically, in the print head 500", n of the aforementioned nozzles groups are aligned in the sub-scanning direction (where n is an integral number not less than two, and n is an even number not less than two in an embodiment where the pitches between the return positions are uniform), and the nozzle groups are staggered mutually in phase in the main scanning direction. In order to obtain an image of higher resolution, it is preferable that the embodiment satisfies $n \geqq 4$.

Furthermore, the nozzle-to-nozzle pitch P1 in the main scanning direction is equal to the distance obtained by dividing the nozzle pitch P between nozzles that are mutually adjacent in the main scanning direction, by n. This is equivalent to assigning each nozzle group with a shift amount based on the unit P/n in the main scanning direction.

The arrangements of the respective nozzle rows within the print head 500" have the substantially same structure, and therefore the nozzle row 530 comprising 20 nozzles that are nozzle 51-101 to nozzle 51-120 is described here as an example of these nozzle rows.

The nozzle row 530 comprises: a nozzle row 532 including nozzle 51-101 to nozzle 51-105; a nozzle row 534 including nozzle 51-106 to nozzle 51-110; a nozzle row 536 including nozzle 51-111 to nozzle 51-115; and a nozzle row 538 including nozzle 51-116 to nozzle 51-120. Nozzle row 532 belongs to nozzle group 542, nozzle row 534 belongs to nozzle group 544, nozzle row 536 belongs to nozzle group 546, and nozzle row 538 belongs to nozzle group 548.

In a nozzle row in which nozzle 51-101 to nozzle 51-120 are projected to align in the main scanning direction, the nozzle row 532 and the nozzle row 534 are arranged in staggered phase in the main scanning direction so that the nozzle 51-109 is located between the nozzle 51-101 and the nozzle 51-102, the nozzle row 534 and the nozzle row 536 are arranged in staggered phase in the main scanning direction so that the nozzle 51-115 is located between the nozzle 51-101 and the nozzle 51-109, and the nozzle row 536 and the nozzle row 538 are arranged in staggered phase in the main scanning direction so that the nozzle 51-118 is located between the nozzle 51-102 and the nozzle 51-109.

More specifically, in the projected nozzle row where the nozzles 51-101 to 51-120 in the nozzle rows 532, 534, 536, and 538 are projected to align in the main scanning direction, the nozzles are arranged so that a nozzle in the nozzle group is located between the adjacent nozzles in the single nozzle group arranged adjacently in the sub-scanning direction. For example, in the projected nozzle row described above, the nozzle 51-109, which belongs to the nozzle group 534 adjacent in the sub-scanning direction to the nozzle group 532, is located between the nozzle 51-101 and the nozzle 51-102, which belong to the nozzle group 532.

In the nozzle arrangement shown in FIG. 14, the pitch P is 0.169 mm between nozzles in the main scanning direction (the nozzle pitch between nozzles that are adjacent in a nozzle row obtained by projecting the nozzles in one nozzle group to align in the main scanning direction), the nozzle pitch P1 is 0.846 mm between the nozzles that are mutually adjacent in the main scanning direction, and the pitch P2 is 0.21 mm between the return positions.

Figure 15:
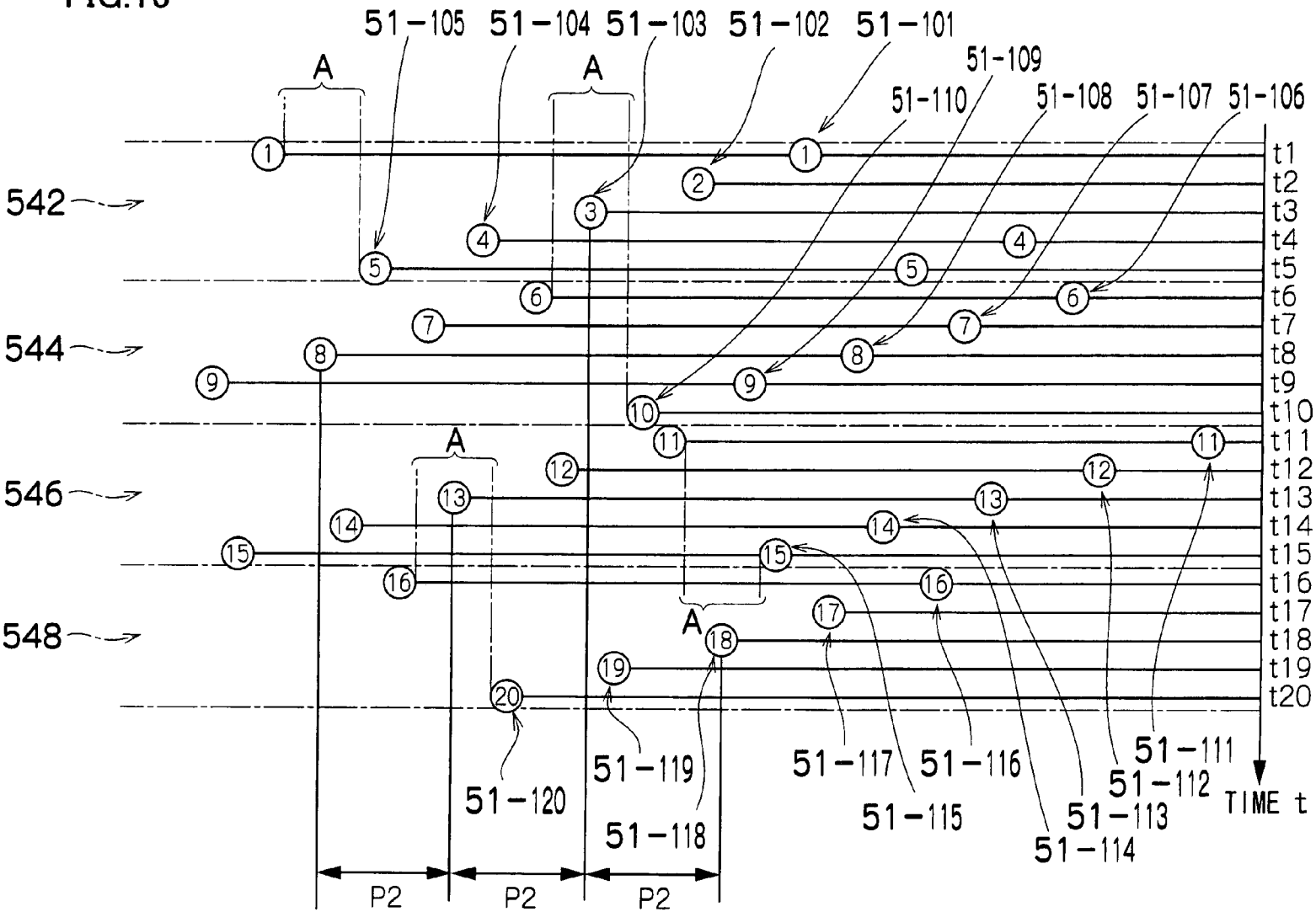
FIG. 15 is a diagram showing the relationship between the nozzle arrangement shown in FIG. 14 and the droplet ejection timing.

FIG. 15 shows the relationship between the nozzle arrangement shown in FIG. 14 and the droplet ejection timing.

As shown in FIG. 15, at timing t1, droplets are ejected from the nozzles aligned with nozzle 51-101 in the main scanning direction, and at timing t2, droplets are ejected from the nozzles aligned with nozzle 51-102 in the main scanning direction. In this way, droplets are sequentially ejected at timing t3 until timing t20 from the nozzles aligned with the nozzle 51-103 in the main scanning direction to the nozzles aligned with the nozzle 51-120 in the main scanning direction.

Figure 16:
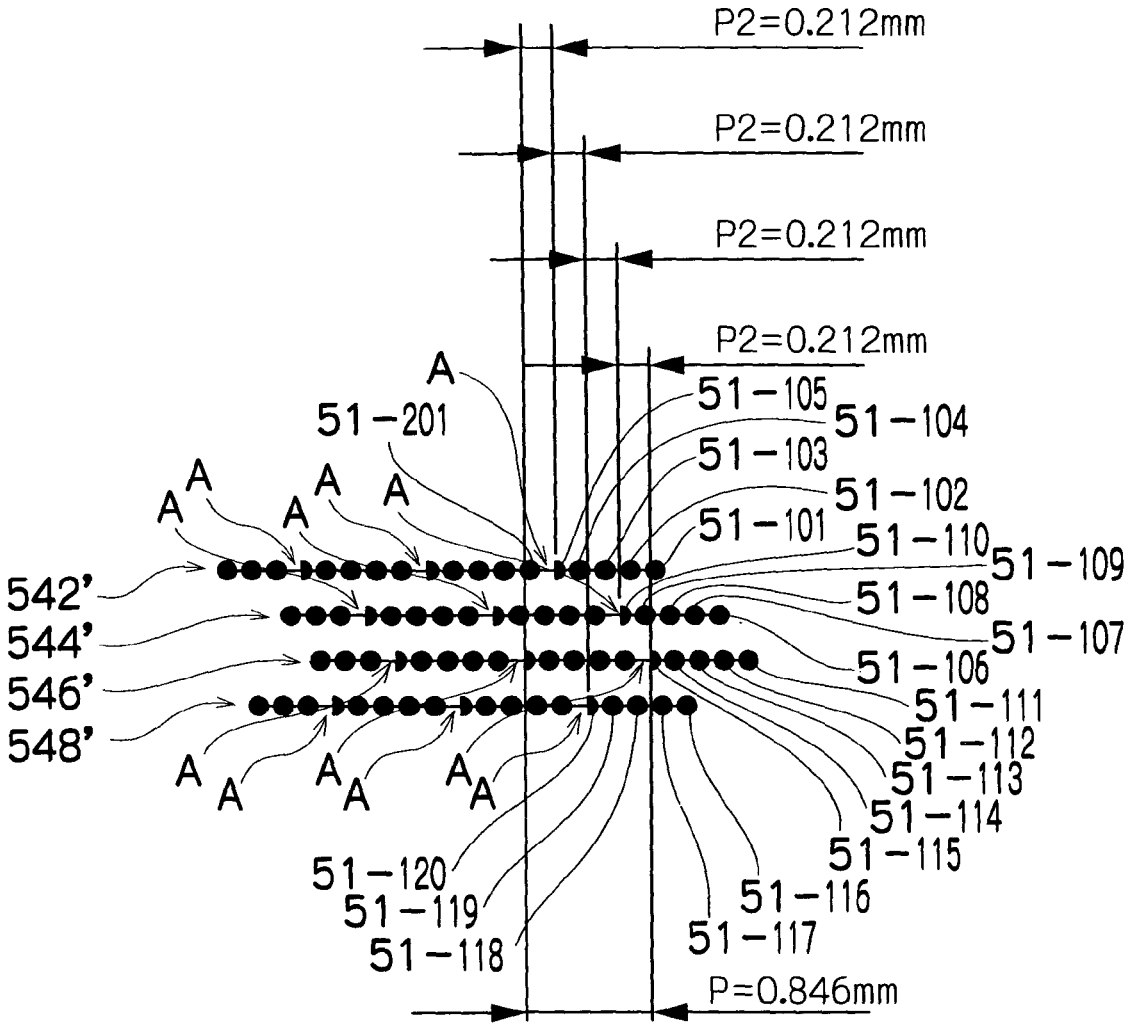
FIG. 16 is a diagram for explaining the nozzle pitch in the main scanning direction at a return position in the nozzle arrangement shown in FIG. 14.

FIG. 16 shows projected nozzle groups 542', 544', 546' and 548' obtained by projecting the nozzle rows of nozzle groups 542, 544, 546 and 548 to align in the main scanning direction.

In FIG. 16, the nozzles at one of the ends of one of the return positions of the projected nozzle groups are denoted by a semicircular shape, and the other nozzles are denoted by a circular shape. Furthermore, the pitches between the return positions, P2, are uniform and the value of P2 is 0.212 mm.

In the print head 500" having the composition described above, the nozzle rows in which nozzles 51 are aligned in a direction oblique to the main scanning direction are divided into n parts in the sub-scanning direction (where n is an even number), and the divided nozzle rows are staggered in phase in the main scanning direction. Therefore, it is possible to improve the peculiarity of the landing interference between ink droplets occurring at the regions corresponding to the return positions A.

Moreover, if the nozzle rows are arranged in such a manner that the pitches P2 between the return positions are substantially uniform, then it is possible to reduce the visibility of striped unevenness occurring at the regions corresponding to the return positions A.

Furthermore, in a multiple-color head having print heads corresponding to respective colors, it is possible to reduce unevenness more effectively by applying the present invention to the return positions in the heads (nozzle groups) corresponding to each color.

In the present embodiment, it has been described that the dot row of one line extending in the main scanning direction is formed by ejecting ink droplets from all of the nozzles in one nozzle row. If the dot row of one line extending in the main scanning direction is formed by ejecting ink droplets from a portion of the nozzles in one nozzle row, for example, then at both ends of the dot row thus formed, the ink droplets are deposited in a state where an adjacent dot is formed on one side only. In this case, the ink droplet may be moved in one direction due to aggregation. However, this phenomenon often occurs at the end portions of the image, and is not readily perceptible as striped unevenness or non-uniform density.

Method of Manufacture and Processing Accuracy of the Head

Next, a method for manufacturing the liquid ejection head according to the present embodiment is described below.

Figure 17A:
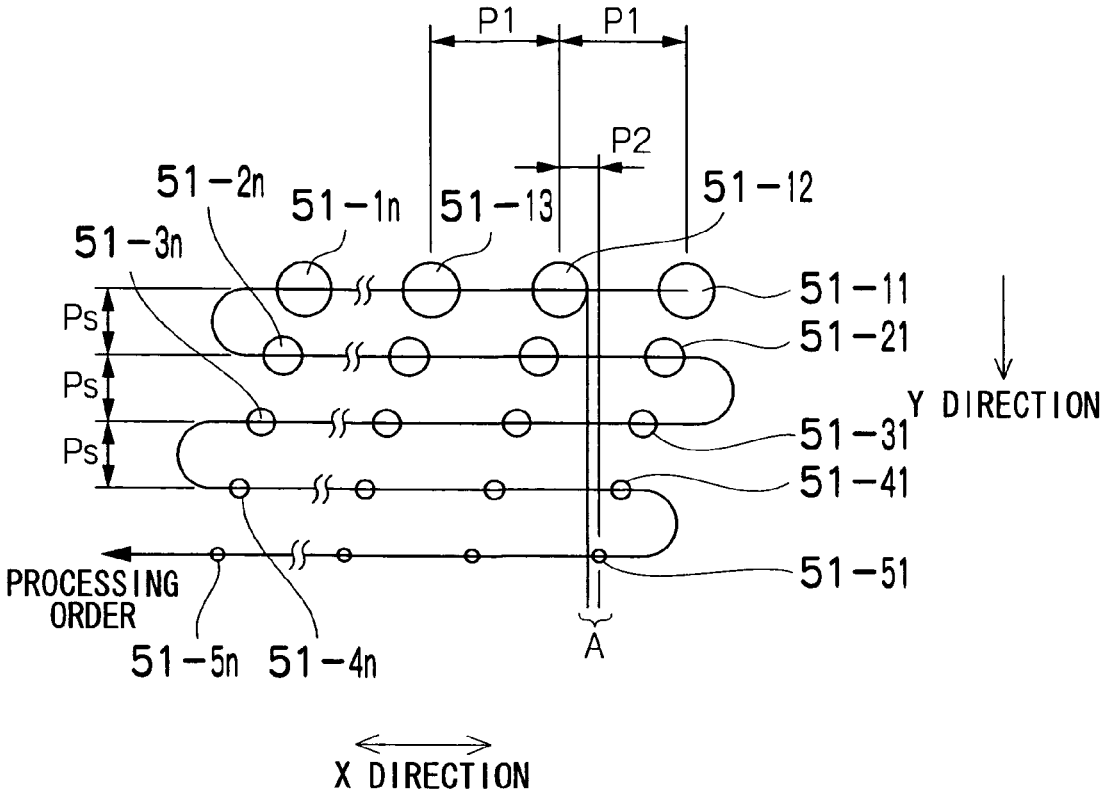
FIGS. 17A and 17B are diagrams for explaining consecutive processing of individual apertures and simultaneous processing of multiple apertures.

FIG. 17A shows an example of processing for forming five nozzles 51 in one column by means of consecutive processing of individual apertures. For this consecutive processing of individual apertures, it is possible to use pressing of a stainless steel plate (plate thickness t =80 μm, and aperture diameter D=30 μm), and/or laser processing of a polyimide sheet (sheet thickness t=70 μm, and aperture diameter D=30 μm).

In continuous processing of individual apertures, the member to be processed is fixed onto an X-Y stage, and the apertures are formed at prescribed positions in the member while the X-Y stage (hereafter, described as "stage") is moved in accordance with NC data (data including the positional information relating to the apertures to be formed).

As shown by the arrow in FIG. 17A, the nozzles are processed in the first line from right to left in FIG. 17A in the order of nozzle 51-11, nozzle 51-21, nozzle 51-31, . . . , and nozzle 51-1*n*, while the stage is successively moved in the X direction in increments of the nozzle-to-nozzle pitch P1 between nozzles that are adjacent in the main scanning direction. After processing of the first row has been completed, the second row is processed by moving the stage in the Y direction by the nozzle pitch Ps between the nozzles in the sub-scanning direction when projected to align in the sub-scanning direction (hereinafter referred to as the nozzle pitch in the sub-scanning direction).

The nozzles of the second row are processed in the order, nozzle 51-2*n*, . . . , nozzle 51-21, while the X-Y stage is successively moved in the X direction in increments of the nozzle pitch P1 between nozzles that are adjacent in the main scanning direction, in the opposite direction of that of the first row.

Similarly, the third row is processed in order from nozzle 51-31 to nozzle 51-3*n*, the fourth row is processed in order from nozzle 51-4*n* to nozzle 51-41, and the fifth row is processed in order from nozzle 51-51 to nozzle 51-5*n*.

In the method described above, a large error can occur in the pitch P2 between the nozzles at the return positions, due to the accumulation of feed errors of the stage in the X direction. Furthermore, although the stage also produces feed error in the Y direction, this can be corrected by means of the droplet ejection timing.

In laser processing, if the outputted energy of the laser varies due to temperature drift, or the like, then the aperture diameter difference (variation in aperture diameter) increases in a non-continuous fashion at the return positions.

Figure 17B:
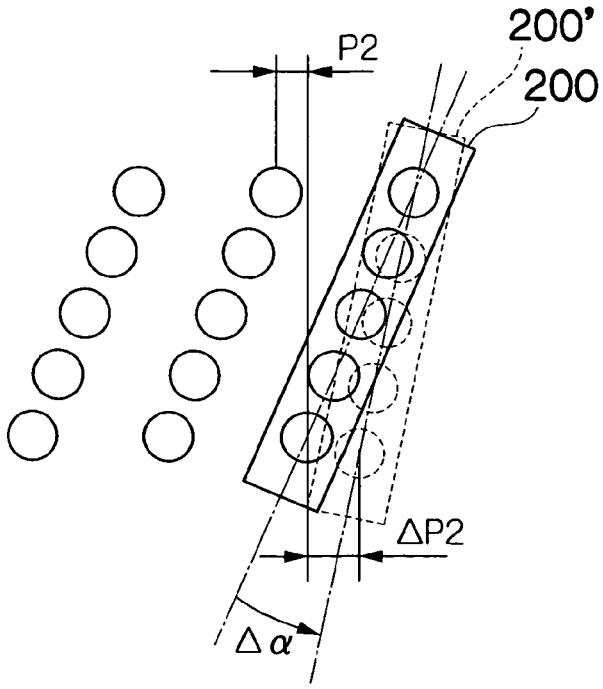

FIG. 17B shows an example of processing where a plurality of apertures are simultaneously formed.

For simultaneous processing of multiple apertures, it is possible to use press processing of a stainless steel plate by means of a 5-aperture punch, or laser processing of a polyimide member by means of an excimer laser mask for 5-aperture.

As shown in FIG. 17B, in simultaneous processing of multiple apertures, the accuracy of the punch or mask influence directly the processing accuracy, and the processing accuracy is significantly affected on if there is rotational displacement of the punch (or mask) 200.

For example, if the punch 200 is displaced in rotation by $\Delta\alpha$, then it will assume the state shown with the broken line denoted by the reference numeral 200'. If the nozzle pitch in the sub-scanning direction Ps is 1 mm, and the inclination of the direction of rotation $\Delta\alpha$ is 25", then the error $\Delta P2$ in the nozzle pitch between nozzles that are mutually adjacent in the main scanning direction will be 0.5 μm or so. Furthermore, if one row comprises 20 nozzles, then if the angle of rotation is inclined by approximately 5" (in other words, if $\Delta\alpha$=5"), the error $\Delta P2$ in the nozzle pitch between nozzles that are mutually adjacent in the main scanning direction will be 0.5 μm or so.

Consequently, by inclining the punch 200 slightly, the error $\Delta P2$ becomes large in the nozzle pitch between nozzles that are mutually adjacent in the main scanning direction.

Although not shown in the drawings, it is desirable to carry out a finishing process as described above, since integrated forming of the nozzles by means of nickel electroforming produces a large variation in aperture diameter and has relatively poor production yield.

The aforementioned problems relating to processing can be alleviated by positioning the nozzles in such a manner that the nozzle pitches P2 between nozzles that are adjacent in the main scanning direction at the return positions A are uniform. Furthermore, if the nozzle pitch P2 between nozzles that are adjacent in the main scanning direction at the return positions is set in such a manner that the spatial frequency concerning the return positions is 2 lp/mm or above, then relatively good quality can be achieved. It is more preferable that the spatial frequency concerning the return positions is 3 lp/mm or above.

Figure 18A:
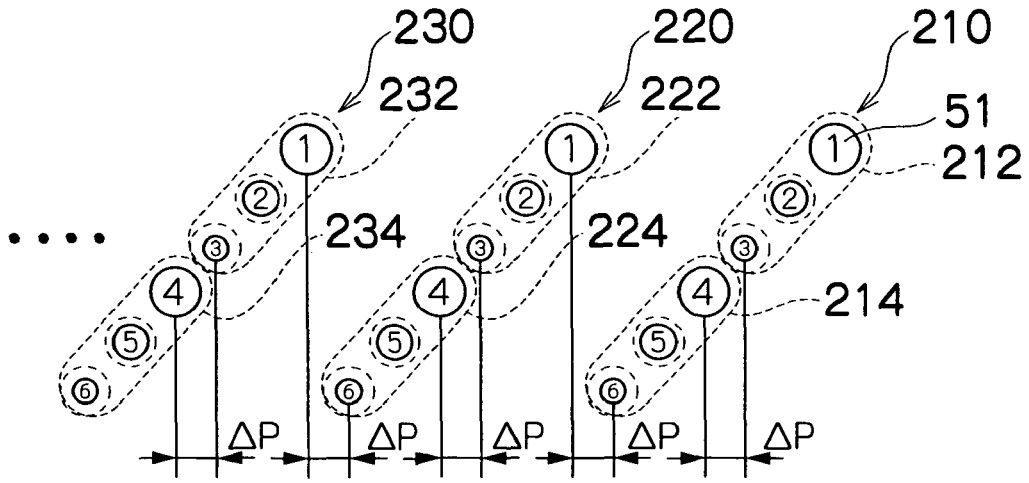
FIGS. 18A and 18B are diagram showing nozzles formed by split processing, and the droplet ejection results.

Furthermore, even in the case of nozzle arrangement shown in FIG. 22A according to the related art, if the processing is divided up as shown in FIG. 18A, then the spatial frequency of the nozzle pitch P between nozzles in the main scanning direction become a high frequency, due to the characteristics of processing, such as positional displacement in processing and variation in the diameter of the apertures formed. Hence, the visibility of striped unevenness and non-uniform density caused by processing errors in the respective nozzles can be reduced.

In the mode shown in FIG. 18A, three apertures are processed simultaneously, and hence a nozzle row comprising six nozzles is formed by two processing operations. More specifically, the nozzle row 210 is divided into the nozzle row 212 and the nozzle row 214, and it is formed by two processing operations. Similarly, the nozzle row 220 is divided into nozzle row 222 and nozzle row 224, the nozzle row 230 is divided into nozzle row 232 and nozzle row 234, and each is formed respectively by means of two processing operations.

If nozzles are formed by means of the processing method described above, then displacement may occur in the positions of the dots due to processing variations at the division-regions of the nozzle rows comprising six nozzles, and at the return positions. However, since the spatial frequency is made high, then it is possible to reduce the visibility of striped unevenness and non-uniform density caused by the processing errors concerning the respective nozzles.

Figure 18B:
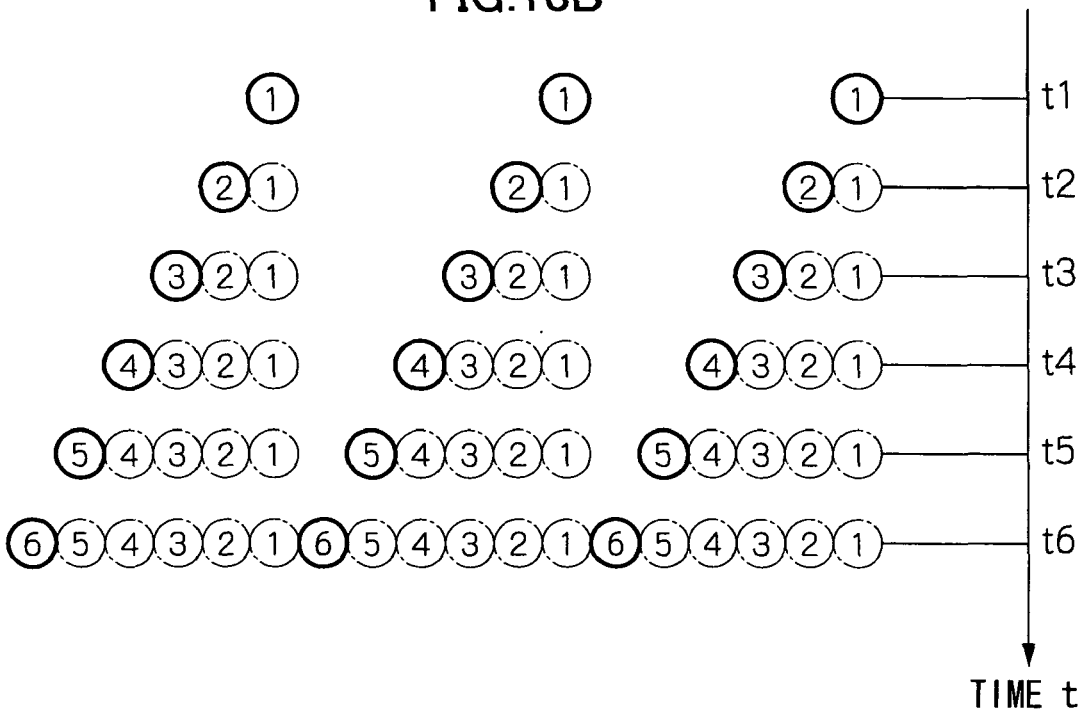

FIG. 18B shows dots formed by ink droplets ejected from the print head having the nozzle arrangement shown in FIG. 18A.

In FIG. 18B, the dots formed by ink droplets ejected at the respective droplet ejection timings are indicated by solid lines, and the dots formed by ink droplets ejected prior to each droplet ejection timing are indicated by the dashed lines.

In the mode shown in FIGS. 18A and 18B, little improvement can be expected with respect to unevenness caused by the peculiarity of the landing interference occurring at the regions corresponding to the return positions. Therefore, the nozzles 51 are arranged in such a manner that the nozzle pitches P2 in the main scanning direction at the return positions are uniform, as shown in FIG. 19A.

Figure 19A:
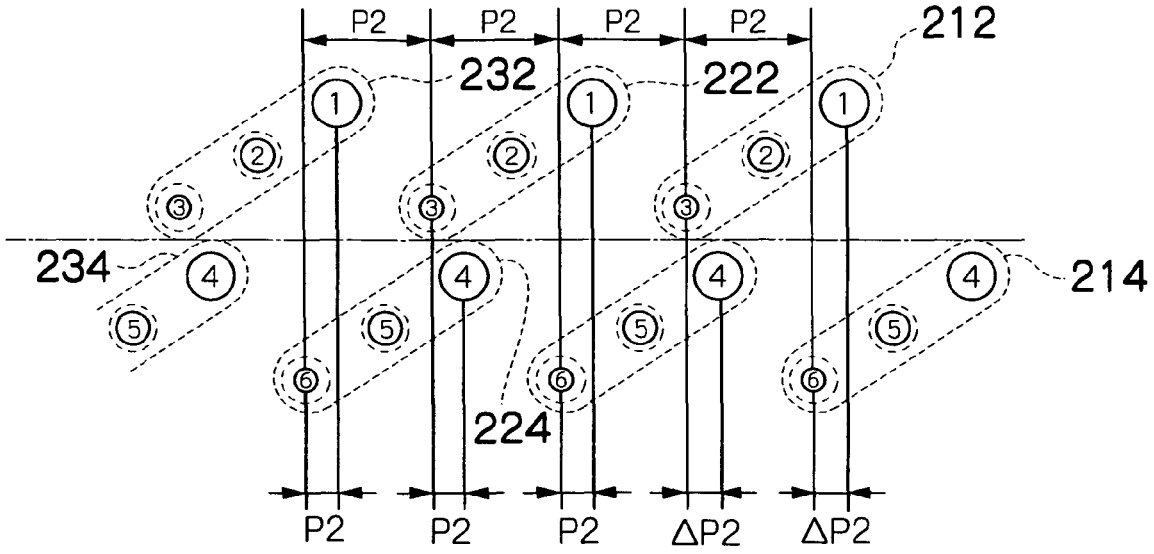
FIGS. 19A and 19B are diagrams showing a print head having a nozzle arrangement formed by split processing according to an embodiment of the present invention, and the droplet ejection results.
Figure 19B:
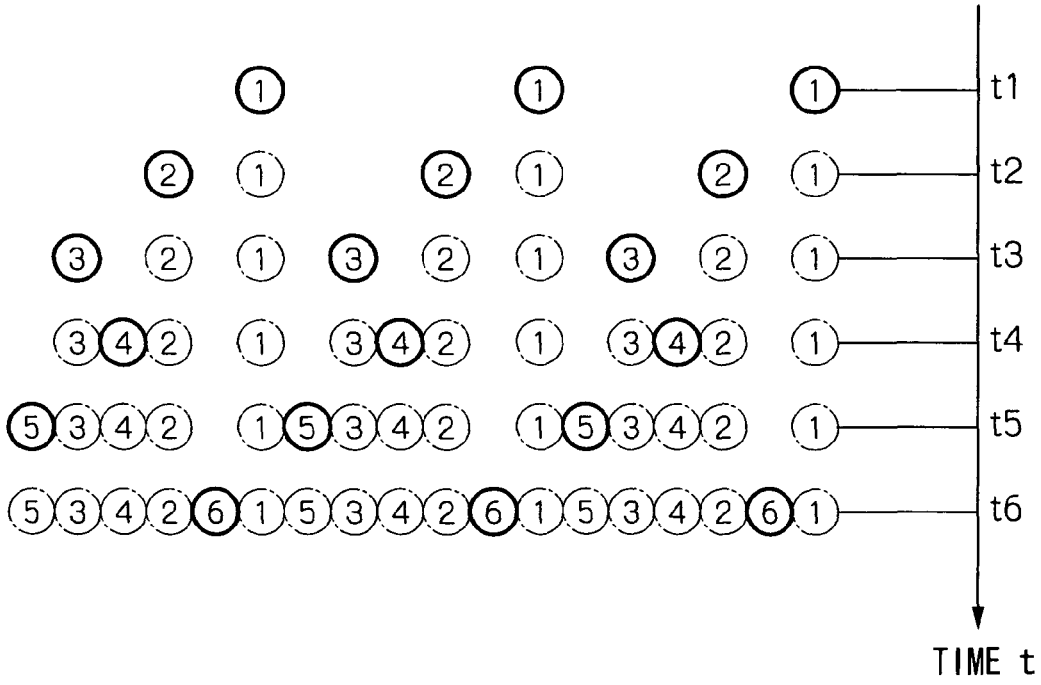

Furthermore, FIG. 19B shows dots formed by ink droplets ejected from the print head having the nozzle arrangement shown in FIG. 19A.

In FIG. 19B, the dots formed by ink droplets ejected at the respective droplet ejection timings are indicated by solid lines, and the dots formed by ink droplets ejected prior to respective droplet ejection timing are indicated by the dashed lines.

In this way, if the processing of the nozzles in one row is divided up and the positions of the nozzles are adjusted by splitting the nozzle rows, then accuracy and production yield can be improved.

Figure 20:
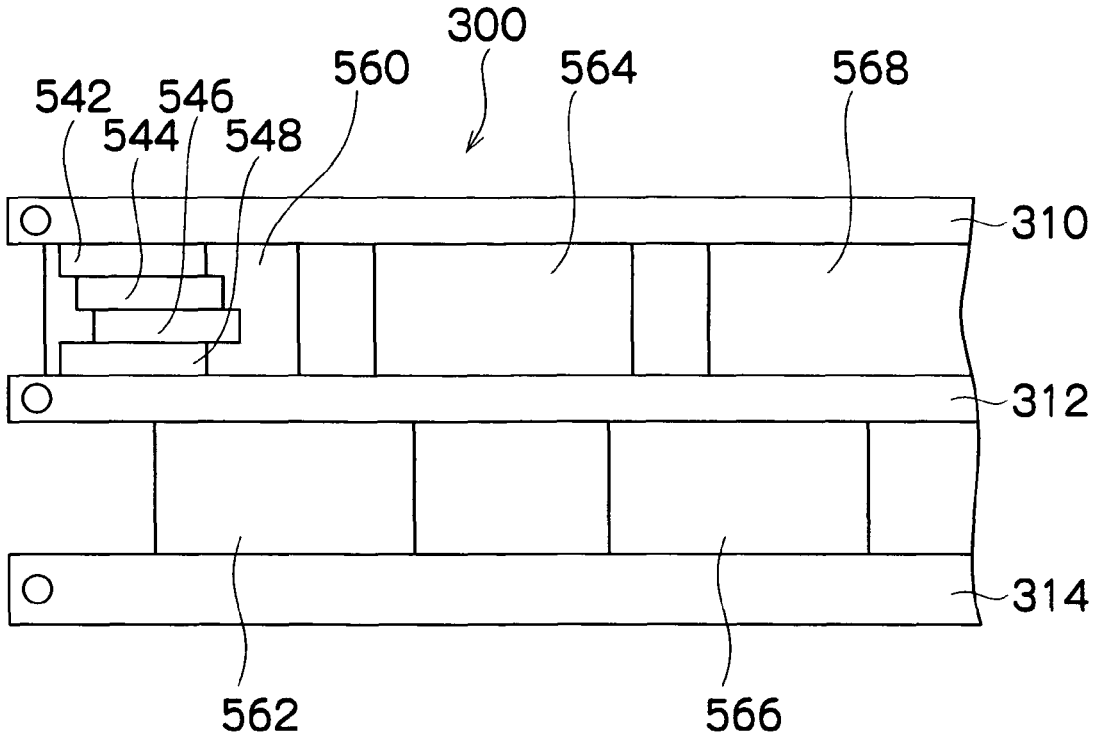
FIG. 20 is a diagram showing an application of the print head according to an embodiment of the present invention.

Furthermore, if the divided matrix structure shown in FIGS. 4 and 14 is manufactured in the form of head blocks with substantially uniform shape (for example, head blocks comprising the nozzle groups 542, 544, 546 and 548 shown in FIG. 14), and a long print head 300 is formed by arranging these head blocks (print heads) 560, 562, 564, 566, 568, and so on, each of which has four nozzle groups 542 to 548, in a staggered matrix fashion as shown in FIG. 20, then processing is easier to carry out and improvements can be expected in both processing accuracy and production yield, compared to a case where a long head is manufactured as a single structure.

In the print head 300 shown in FIG. 20, the adjustment mechanism and test printing described in Japanese Patent Application Publication No. 2002-337320 also functions effectively. The landing interference differs between a case where a droplet is ejected onto a separate landing positions (especially, in the first head block), and a case where droplets are ejected onto adjacent landing positions (especially, in the last head block). Therefore, the shape and density of the dots formed on the landing positions may vary. However, since droplets are ejected so as to fill in between the dots, the spatial frequency is high and the visibility of unevenness is low. Furthermore, it is also possible to control ejection in accordance with the position of the nozzle.

Furthermore, in the print head 300 shown in FIG. 20, the main channels of the head blocks 560, 564 and 568 on the upper side in FIG. 20 are mutually communicated and an upper side main channel 310 and an intermediate main channel 312 are formed. Similarly, the main channels of the lower side head blocks 562 and 564 are mutually communicated, and a lower side main channel 314 and an intermediate main channel 312 are formed. The intermediate main channel 312 formed between the upper side head block and the lower side head block is formed by unifying the lower side main channel of the upper head block and the upper side main channel of the lower head block.

Therefore, as shown in FIG. 20, it is possible to achieve even greater miniaturization if a composition is adopted in which the main flow channels 55A shown in FIGS. 3 and 14 are shaped so as to be connectable. Furthermore, as shown in FIG. 21, it is also possible to implement a leak test in each individual head block.

Figure 21:
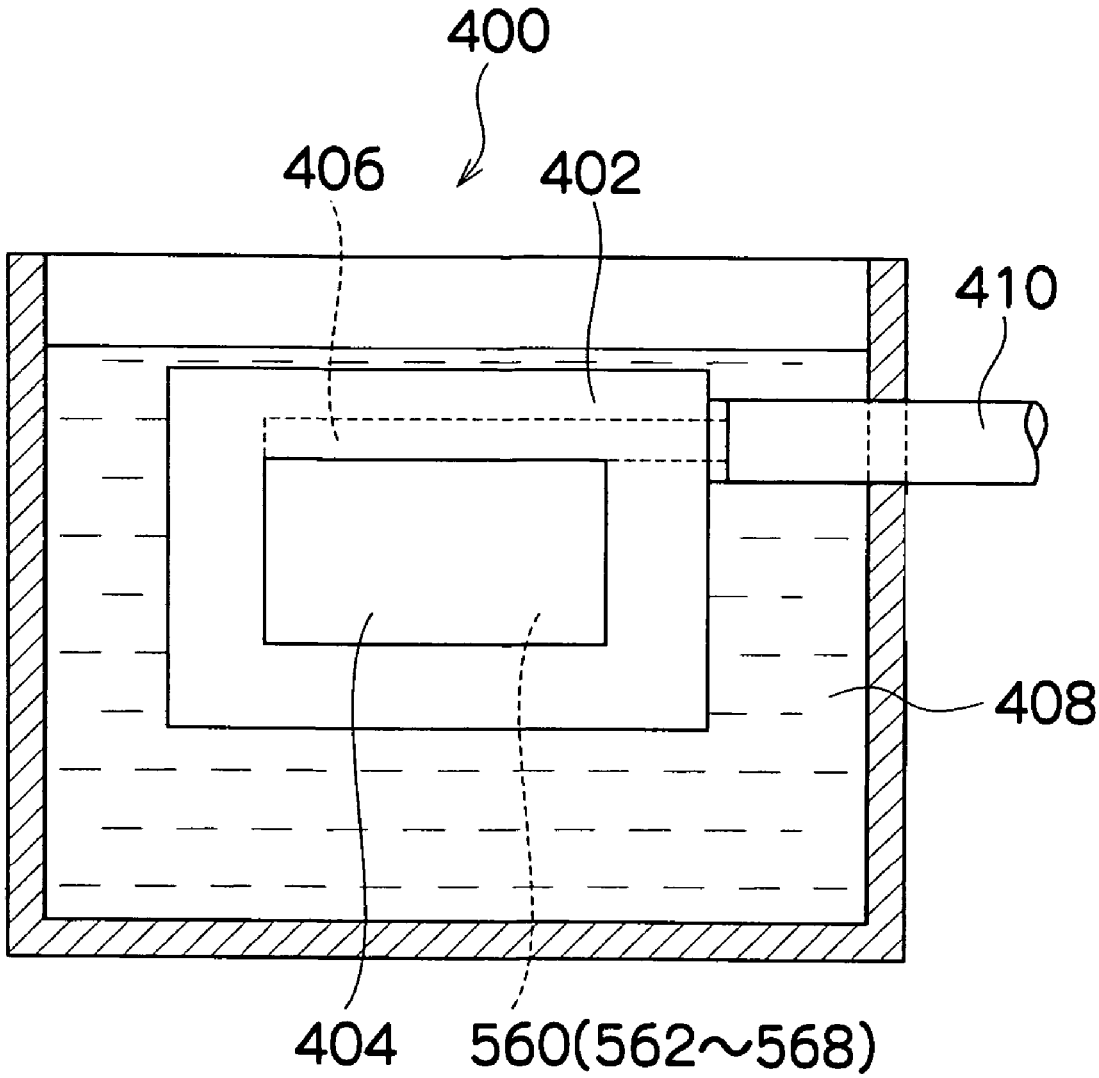
FIG. 21 is a diagram showing a test device for a print head according to an embodiment of the present invention.

FIG. 21 shows a leak test (sealing test) device 400, for the head block 560, or the like, shown in FIG. 20. The head blocks 560, 562 and so on, shown in FIG. 20, have the same structure, and therefore, the head block 560 is described below.

In the leak test device 400, the head block 560 is accommodated in a test jig 402, and the nozzles 51 is hermetically sealed by means of a sealing member 404 of a rubber plate, or the like.

Furthermore, one of the openings forming a branch end section provided at either end of the head block 560 is communicated with a pipe 406 (shown by dotted lines) inside the jig 402, and the other opening forming a branch end section is sealed by being accommodated in the jig 402.

The head block 560, accommodated in the test jig 402 in this manner, is placed in a liquid 408 (a liquid that does not contain material that may soil the print head 560, such as pure water), and the head block 560 is filled with a gas that does not dissolve in the liquid 408, such as a flon gas, by means of a filling device 410. In this circumstances, it is possible to test the sealing properties of the head block 560 according to whether or not the gas comes out into the liquid 408.

Although an print head used in an inkjet recording apparatus is described as an example of a liquid droplet ejection head in the present embodiment, the present invention may also be applied to an ejection head used in a liquid ejection apparatus that forms images, circuit wiring and shapes, such as machining patterns, by ejecting a liquid (such as water, a chemical solution, resist, and processing liquid) onto an ejection receiving medium, such as a wafer, glass substrate, epoxy substrate, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An ejection head, comprising:

n (where n is an integer not less than 2) ejection aperture groups arranged in a sub-scanning direction, each of the groups including ejection aperture rows arranged at prescribed intervals in a main scanning direction, each of the ejection aperture rows including a plurality of ejection apertures aligned in an oblique direction with a prescribed angle θ (where $0<\theta<90°$) with respect to the main scanning direction, wherein:

ejection apertures for a row in a first ejection aperture group are phase offset in the main scanning direction relative to ejection apertures in said row for a second ejection aperture group, such that along said main scanning direction, ejection apertures of the first ejection aperture group alternate with ejection apertures of the second ejection aperture group;

n is an even number;

a pitch between the ejection apertures in the sub-scanning direction is greater than other pitches between other ejection apertures; and the ejection aperture groups are arranged at different phases in the main scanning direction, in such a manner that, pitches between return positions projected to align in the main scanning direction are uniform, where return positions are boundaries between the ejection aperture rows arranged adjacently in the main scanning direction of the ejection aperture rows in the ejection aperture groups.

2. The ejection head as defined in claim 1, wherein the ejection apertures are arranged so as to be arranged at different locations in a projected ejection aperture row, wherein the projected ejection aperture row is obtained by projecting the ejection apertures to dispose the ejection apertures in the main scanning direction.

3. The ejection head as defined in claim 1, wherein all the ejection apertures included in the first ejection aperture group are phase offset in the main scanning direction relative to all the ejection apertures included in the second ejection aperture group.

4. An image forming apparatus, comprising:

an ejection head having n (where n is an integer not less than 2) ejection aperture groups arranged in a sub-scanning direction, each of the groups including ejection aperture rows arranged at prescribed intervals in a main scanning direction, each of the ejection aperture rows including a plurality of ejection apertures aligned in an oblique direction with a prescribed angle θ (where $0°<\theta<90°$) with respect to the main scanning direction, wherein ejection apertures for a row in a first ejection aperture group are phase offset in the main scanning direction relative to ejection apertures in said row for a second ejection aperture group, such that along said main scanning direction, ejection apertures of the first ejection aperture group alternate with ejection apertures of the second ejection aperture group; and an ejection controller which controls the image forming apparatus to form a dot row in the main scanning direction on an ejection receiving medium in such a manner that, droplets are ejected from the ejection head so that when a droplet ejected from one of the ejection apertures lands on the ejection receiving medium, droplets that are, with the exception of on ends of the dot row, adjacent to the droplet ejected from the one of the ejection apertures have already been present on both sides of the droplet or have not been present on both sides of the droplet.

5. The image forming apparatus as defined in claim 4, wherein:

n is an even number;

a pitch between the ejection apertures in the sub-scanning direction is greater than other pitches between other ejection apertures, and the ejection aperture groups are arranged at different phases in the main scanning direction, in such a manner that, pitches between the return positions projected to align in the main scanning direction are uniform, where return positions are boundaries between the ejection aperture rows arranged adjacently in the main scanning direction of the ejection aperture rows in the ejection aperture groups.

6. The image forming apparatus as defined in claim 4, further comprising:

a conveyance device which moves the ejection receiving medium relatively with respect to the ejection head by conveying at least one of the ejection head and the ejection receiving medium, wherein the ejection controller controls the image forming apparatus so that one dot row is formed in the main scanning direction on the ejection receiving medium, by means of one cycle of ejection in which ejection is performed sequentially from the ejection aperture on an uppermost side in direction of relative movement of the ejection receiving medium until the ejection aperture on an lowermost side in the direction of the relative movement, while at least one of the ejection head and the ejection receiving medium onto which the droplets are ejected from the ejection head is moved in the sub-scanning direction.

7. The image forming apparatus as defined in claim 4, wherein the ejection aperture groups are arranged at different phases in the main scanning direction in such a manner that, maximum value $\delta Tmax1$ of adjacent-landing-time differences between adjacent landing times concerning the ejection apertures that eject the droplets to form the dots being mutually adjacent in the main scanning direction, and maximum value $\delta Tmax2$ of landing-time differences between landing times concerning the ejection apertures in the ejection head satisfy the following relationship: $\delta Tmax1 < \delta Tmax2$.

8. The image forming apparatus as defined in claim 4, wherein the ejection aperture groups are arranged at different phases in the main scanning direction in such a manner that, minimum value $\delta Tmin1$ of adjacent-landing-time differences between the landing times concerning the ejection apertures that eject the droplets to form the dots being mutually adjacent in the main scanning direction, and maximum value $\delta Tmax1$ of the adjacent-landing-time differences satisfy the following relationship: $\delta Tmin1/\delta Tmax1 \geqq 0.5$.

9. The image forming apparatus as defined in claim 4, wherein the ejection head is a full line type ejection head comprising at least one set of the plurality of ejection apertures aligned in a range of a length corresponding to an entire printable width of the ejection receiving medium.

* * * * *